US006768106B2

(12) United States Patent
Gzara et al.

(10) Patent No.: US 6,768,106 B2
(45) Date of Patent: Jul. 27, 2004

(54) METHOD OF KICK DETECTION AND CUTTINGS BED BUILDUP DETECTION USING A DRILLING TOOL

(75) Inventors: Kais Gzara, Tunis (TN); Iain M. Cooper, Linton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 32 days.

(21) Appl. No.: 09/960,445

(22) Filed: Sep. 21, 2001

(65) Prior Publication Data

US 2003/0057366 A1 Mar. 27, 2003

(51) Int. Cl.[7] ..... G01V 5/12
(52) U.S. Cl. ..... 250/269.3
(58) Field of Search ..... 250/269.3

(56) References Cited

U.S. PATENT DOCUMENTS

| | | | | |
|---|---|---|---|---|
| 3,688,115 | A | | 8/1972 | Antkiw |
| 4,297,575 | A | | 10/1981 | Smith, Jr. et al. |
| 4,412,130 | A | | 10/1983 | Winters |
| 4,479,564 | A | | 10/1984 | Tanguy |
| 4,492,865 | A | | 1/1985 | Murphy et al. |
| 4,495,803 | A | * | 1/1985 | Beasley et al. ..... 73/152.19 |
| 4,637,479 | A | | 1/1987 | Leising |
| 4,698,501 | A | | 10/1987 | Paske |
| 4,879,463 | A | | 11/1989 | Wraight et al. |
| 5,017,778 | A | | 5/1991 | Wraight |
| 5,130,950 | A | | 7/1992 | Orban et al. |
| 5,144,126 | A | | 9/1992 | Perry et al. |
| 5,237,540 | A | | 8/1993 | Malone |
| 5,469,736 | A | | 11/1995 | Moake |
| 5,473,158 | A | | 12/1995 | Holenka et al. |
| 5,847,384 | A | * | 12/1998 | Mathis ..... 250/269.3 |
| 6,032,102 | A | | 2/2000 | Wijeyesekera et al. |
| 6,167,348 | A | | 12/2000 | Cannon |
| 6,176,323 | B1 | | 1/2001 | Weirich et al. |
| 6,220,371 | B1 | | 4/2001 | Sharma et al. |

OTHER PUBLICATIONS

JS Wahl, J Tittman, CW Johnstone and RP Alger, "The Dual Spacing Formation Density Log," *SPE* 39$^{th}$ Annual Meeting (Dec. 1964).

D Best, P Wraight and J Holenka, "An Innovative Approach to Correct Density Measurements while Drilling for Hole Size Effect," *SPWLA* 31$^{st}$ Annual Logging Symposium (Jun. 24–27, 1990).

* cited by examiner

*Primary Examiner*—Constantine Hannaher
(74) *Attorney, Agent, or Firm*—Kevin P. McEnaney; Brigitte L. Jeffery; John H. Ryberg

(57) ABSTRACT

A method comprising determining a characteristic of a mud mixture surrounding a drilling tool within an inclined borehole in which a drilling tool is conveyed. The method includes defining a cross-section of the tool which is orthogonal to a longitudinal axis of the tool. A bottom contact point of the cross-section of the tool is determined, which contacts the inclined borehole as the tool rotates in the borehole. The cross-section is separated into at least two segments, where one of the segments is called a bottom segment of the borehole which includes the bottom contact point of the cross-section of the tool with the inclined borehole. The tool is turned in the borehole. Energy is applied into the borehole from an energy source disposed in the tool, as the tool is turning in the borehole. Measurement signals are received at a sensor disposed in the tool from circumferentially spaced locations around the borehole, where the measurement signals are in response to returning energy which results from the interaction of the applied energy with the mud mixture and the formation. The measurement signals are associated with a particular segment during the time such signals are produced in response to energy returning from the mud mixture and the formation as the tool is turning in the borehole. An indication of a characteristic of the mud mixture is derived as a function of the measurement signals associated with a plurality of the at least two segments of the borehole. The indications of a characteristic of the mud mixture for the plurality of segments are compared with at least one of each other and a known indication of a characteristic of the mud mixture.

25 Claims, 27 Drawing Sheets

FIG. 4A
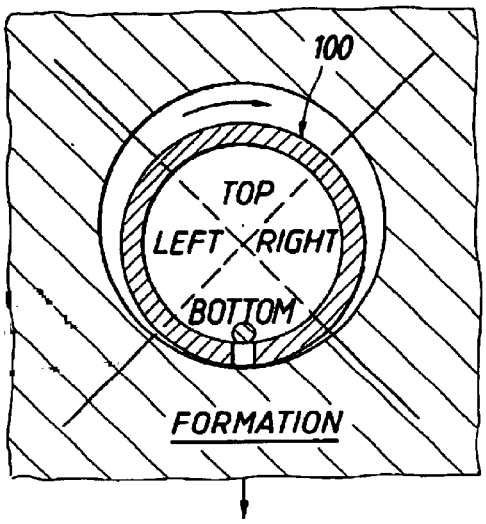
FIG. 4B
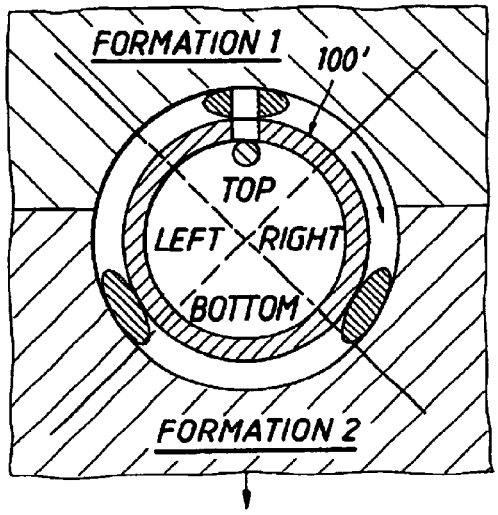
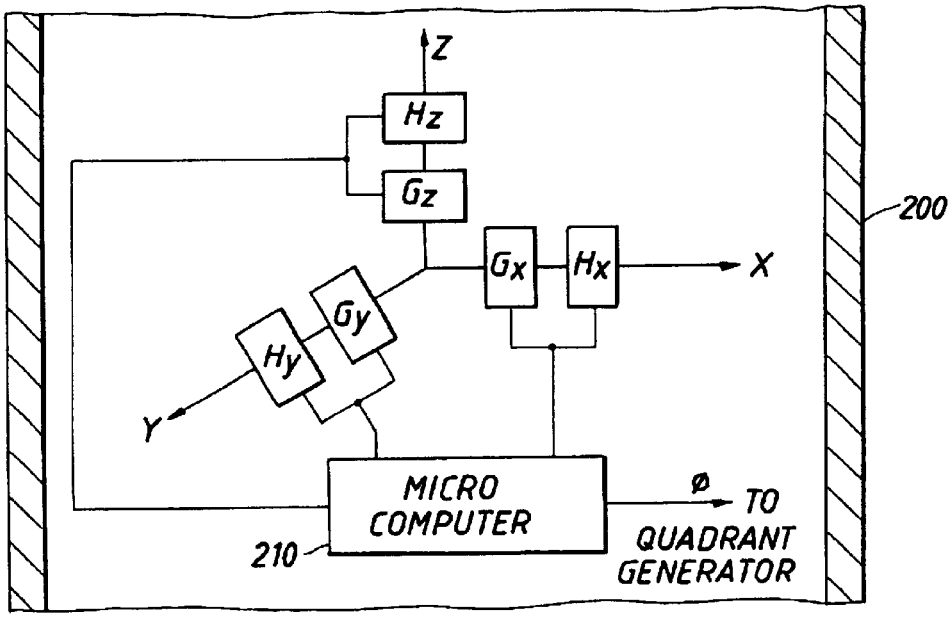
FIG. 5A
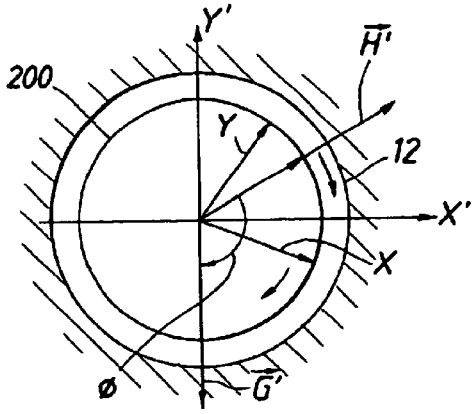
FIG. 5B

FIG. 6A

300

302

MAGNETOMETER SECTION

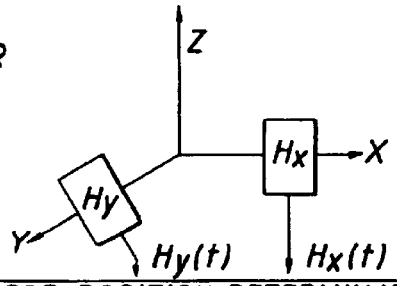

QUADRANT/SENSOR POSITION DETERMINATION COMPUTER PROGRAM

DETERMINE DOWN DIRECTION

- DETERMINE $\vec{H}'(t)$ VECTOR FROM $H_x(t)$, $H_y(t)$, $\angle\theta(t)$
- DETERMINE DOWN DIRECTION ANGLE $$\theta = \cos^{-1} \frac{H_x(t)}{(H_x^2 + H_y^2)^{1/2}}$$

$\phi$ $\angle\vec{H}'(t) = \theta(t)$ AS MEASURED FROM TOOL X-AXIS $\angle\vec{D}(t) = \theta(t) - \phi$ AS MEASURED FROM TOOL X-AXIS

- DETERMINE BOTTOM QUADRANT

310

$Q_{BOT}(t) = \angle\vec{D}(t) - 45°$ TO $\angle\vec{D}(t) + 45°$ $Q_{LEFT}(t) = \angle\vec{D}(t) + 45°$ TO $\angle\vec{D}(t) + 135°$ $Q_{TOP}(t) = \angle\vec{D}(t) + 135°$ TO $\angle\vec{D}(t) + 225°$ $Q_{RIGHT}(t) = \angle\vec{D}(t) + 225°$ TO $\angle\vec{D}(t) - 45°$

- DETERMINE QUADRANT OF SENSOR $\angle\vec{S}(t)$ IS MEASURED FROM X-AXIS AND $\vec{H}'(t)$ VECTOR $\angle\vec{S}$ IS $\alpha$ DEGREES FROM X-AXIS $\angle\vec{H}'(t)$ IS $\theta(t)$ DEGREES FROM X-AXIS $\angle\vec{S}(t) = \alpha$ AS MEASURED FROM X-AXIS IS IN $Q_{BOT}$ WHEN $\angle\vec{S}(t) = \alpha$ IS BETWEEN $\theta(t) - \phi - 45°$ AND $\theta(t) - \phi + 45°$, ETC.

FIG.6B
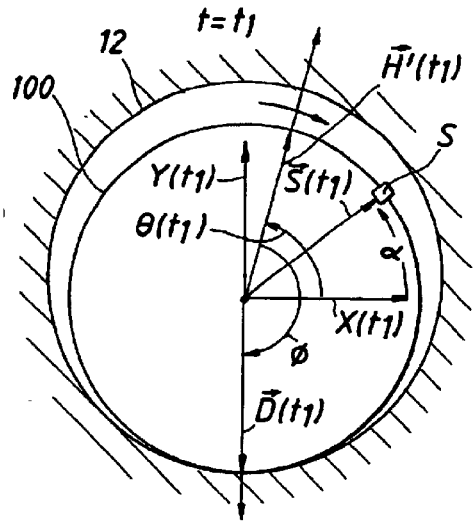
FIG.6C
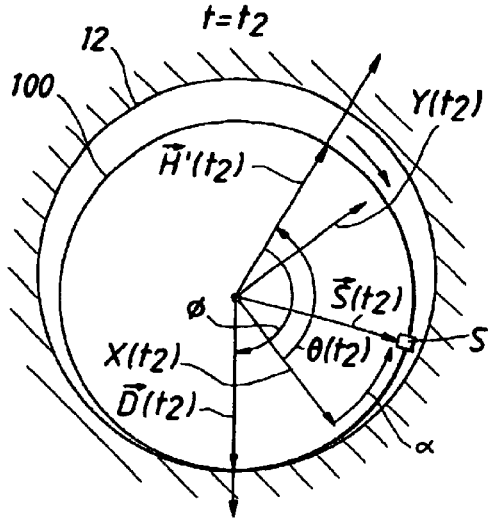
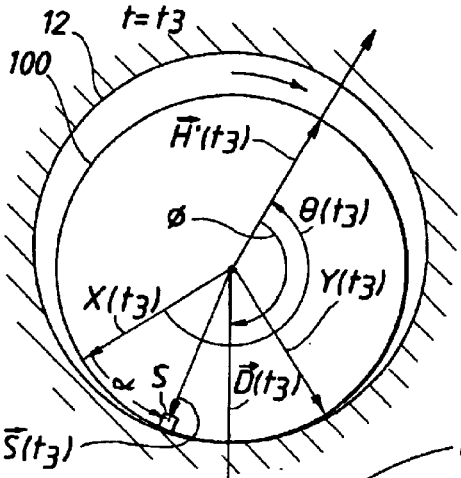
FIG.6D
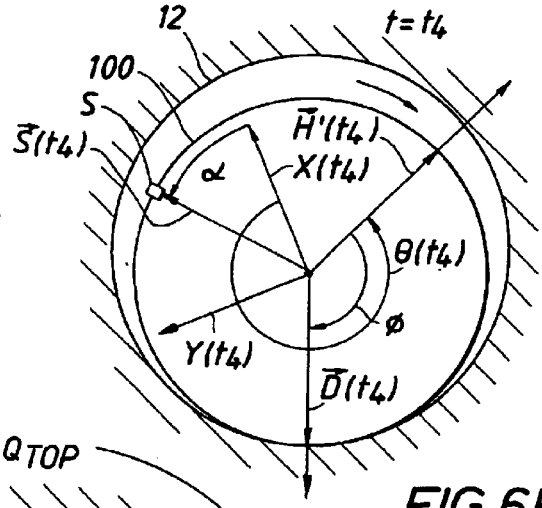
FIG.6E
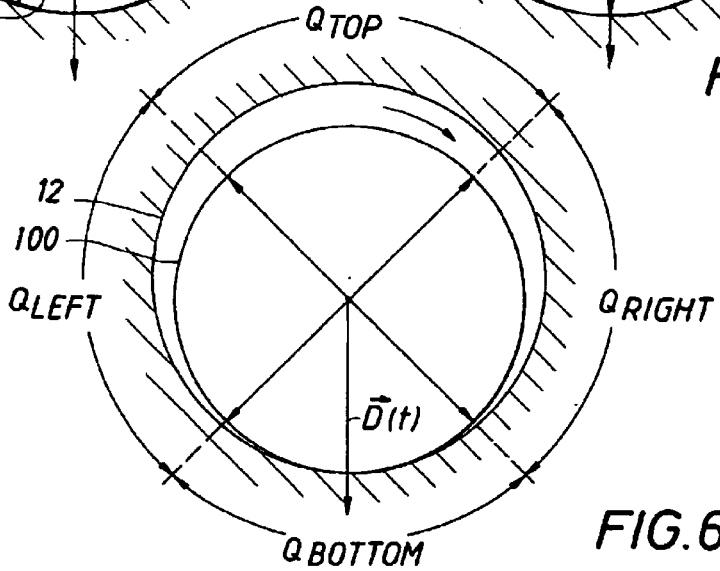
FIG.6F

TO FIG. 10A-2

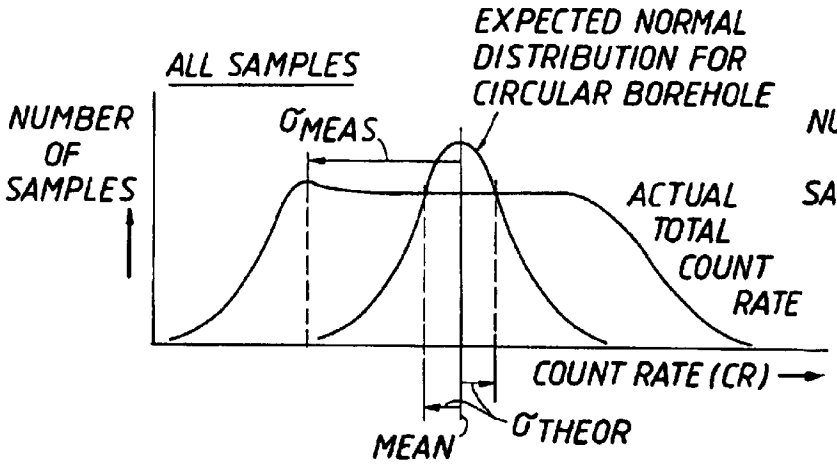

$$\Delta CR = A\sqrt{\sigma^2 MEAS - \sigma^2 THEOR}$$

$$\Delta \rho_{ROT} = (ds)\left[\ln\left(\frac{CR + \Delta CR}{CR - \Delta CR}\right)\right]$$

$$\rho_{bROT} = D\rho_L + E\rho_S + F\Delta\rho_{ROT}$$

$\rho_L$ = LONG SPACING DENSITY $\rho_S$ = SHORT SPACING DENSITY

FIG. 10D-1

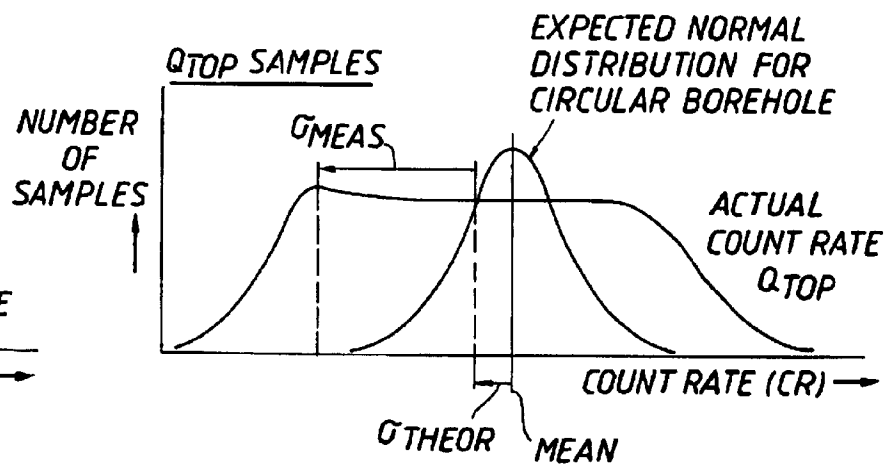

$$\Delta CR_{TOP} = A\sqrt{\sigma^2 MEAS_{TOP} - \sigma^2 THEOR_{TOP}}$$

$$\Delta \rho_{ROT\,TOP} = (ds)\left[\ln\left(\frac{CR_{TOP} + \Delta CR_{TOP}}{CR_{TOP} - \Delta CR_{TOP}}\right)\right]$$

$$\rho_{bROT\,TOP} = D\rho_{L\,TOP} + E\rho_{S\,TOP} + F\Delta\rho_{ROT\,TOP}$$

$\rho_{L\,TOP}$ = LONG SPACING DENSITY$_{TOP}$ $\rho_{S\,TOP}$ = SHORT SPACING DENSITY$_{TOP}$

FIG. 10D-2

FIG. 12D

335

COMPUTER PROGRAM FOR ROTATIONAL PHOTOELECTRIC EFFECT (PEF) OUTPUTS

FROM FIG. 8

TOTAL SOFT WINDOW COUNT RATE SAMPLES$_{LNG.OR\ SHT.}$
TOTAL HARD WINDOW COUNT RATE SAMPLES$_{LNG.OR\ SHT.}$
ACQUISITION TIME SAMPLES

- DETERMINE MACROSCOPIC CROSS-SECTION U's AS A FUNCTION OF ACQUISITION TIME $$U_t = \left[\frac{K}{\left(\frac{\text{SOFT COUNT RATE}}{\text{HARD COUNT RATE}}\right)^{-B}}\right]^{-C}$$

- DETERMINE STANDARD DEVIATION FROM $U_t$'s
- DETERMINE $PEF_{ROT}$ FROM DISTRIBUTION OF $U_t$'s $PEF_{ROT}$

FROM FIG. 8

SOFT WINDOW COUNT RATE SAMPLES IN $Q_{BOT}$ $_{LNG.OR\ SHT.}$
HARD WINDOW COUNT RATE SAMPLES IN $Q_{BOT}$ $_{LNG.OR\ SHT.}$
ACQUISITION TIME SAMPLES

- DETERMINE MACROSCOPIC CROSS-SECTION $U_{BOT}$'s AS A FUNCTION OF ACQUISITION TIME $$U_{t_{BOT}} = \left[\frac{K}{\left(\frac{\text{SOFT COUNT RATE}}{\text{HARD COUNT RATE}}\right)^{-B}}\right]^{-C}$$

- DETERMINE STANDARD DEVIATION FROM $U_{t\,BOT}$'s
- DETERMINE $PEF_{ROT\,BOT}$ FROM DISTRIBUTION OF $U_{t\,BOT}$'s $PEF_{ROT\,BOT}$

TO FIG. 12E

COPY OF PAPERS ORIGINALLY FILED

METHOD OF KICK DETECTION AND CUTTINGS BED BUILDUP DETECTION USING A DRILLING TOOL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF INVENTION

1. Field of the Invention

The invention relates generally to exploration and production, and more particularly, to a method and apparatus for monitoring and detecting kicks and cuttings-bed formation or drill cuttings "pack-off" while drilling.

2. Background Art

The characteristics of geological formations are of significant interest in the exploration for and production of subsurface mineral deposits, such as oil and gas. Many characteristics, such as the hydrocarbon volume, porosity, lithology, and permeability of a formation, may be deduced from certain measurable quantities. Among these quantities are the non-invaded resistivity, flushed zone resistivity, and diameter of invasion in a formation. In addition, the resistivity of the mud mixture and the distance from the tool face to the formation through the mud can be determined with resistivity measurements. The quantities are typically measured by logging-while-drilling ("LWD") and wireline tools. The tool carries one or more sources that radiate energy into the formation and receivers that sense the result of the radiation. The detectors measure this result and either transmit the data back uphole or temporarily store it downhole. Typically, once uphole, the data is input to one or more formation evaluation models, which are typically software programs used to evaluate the geological formation from which the data was gathered. Also, the effect of the mud mixture present in front of the tools, between the tool and the formation which is to be evaluated, is typically considered as an undesirable borehole effect, for which measurements have to be corrected.

Formation evaluation models usually assume thick beds within the formation that lie normal to the wellbore. These beds are also assumed to be homogeneous not only in composition, but in structure in all azimuths about the wellbore. Logging tools were traditionally designed and built with these assumptions as a guide. These assumptions simplified modeling the formations, which is valuable from the perspective of computing resources.

Formation evaluation models typically give little regard to the side of the borehole on which the tools measure or to whether the tools are azimuthally focused, because formation properties in all directions are assumed to be the same. This is not a problem in thick beds with bedding normal to the wellbore, i.e., in situations where the formation structure actually matches the assumptions. When the bed is no longer normal to the wellbore, however, the measurements can become quite different from one side of the borehole to the other. Without processing, it is impossible to obtain accurate results when combining azimuthally focused measurements (e.g., a wireline or logging while drilling density measurement) and azimuthally omni-directional measurements (e.g., a wireline or logging while drilling induction resistivity measurement). The azimuthally focused tool may respond to one bed while the azimuthally non-focused tool responds to the average of multiple beds. The geometrical effects of dip must be removed before meaningful processing can proceed.

Fluid distribution is another area that many models ignore. In permeable, dipping formations, invasion of drilling fluid is often asymmetric because of gravity slumping of the filtrate. ("Dipping" is used herein as a relative term which concerns the relative angle between the wellbore and the bedding plane.) More rigorous two-dimensional interpretation models do include filtrate invasion, but ignore dipping beds and azimuthal variations of the invasion. Azimuthal variations are generally not of concern in vertical wells with bedding normal to the wellbore. However, they become important as beds begin to dip or the well becomes deviated. Such variations can be due to dip and asymmetric filtrate invasion.

Gravity also complicates an evaluation. It segregates invading filtrate from formation fluids if there is a density difference. This is especially pronounced in gas zones with large density contrast. Differential pressure between the mud column and the formation creates the initial invasion, normal to the wellbore. This invasion penetrates the formation only so far before gravity dominates at which point the majority of filtrate begins to flow downward rather than outward. "Down" does not have to mean toward the bottom of the hole; it could mean toward one of the sides of the hole, if that is the down direction of the bedding. The higher the vertical permeability the more obvious this effect. The heavier fluid will puddle at the first impermeable layer. This puddling can appear on wireline logs (and LWD logs if sufficient time has elapsed since drilling) as an apparent water leg at the base of thick, highly permeable gas zones, even though those zones produced dry gas.

In vertical wells, thin, low permeability layers, which minimize segregation, often mask the effect. If the spacing between layers is less than the axial resolution of the logging tool, then they will not be detectable. In the case of dipping beds, the segregation effect is more obvious. All of the filtrate that leaves the well eventually migrates down dip, even the filtrate that leaves on the up-dip side of the wellbore. This increases the depth of invasion in one direction, making it more obvious on deeper reading logging tools and it creates azimuthal variations of fluids.

Thus, formation evaluations of deviated wells and wells with dipping beds are a challenge, especially with gas reservoirs. Log responses in these wells are often considered "unexplainable." Asymmetry, fluid distribution, and gravity contribute greatly to this problem because of the assumptions one-dimensional and two-dimensional formation evaluation models embody. Even calibration of logs to core samples can be difficult because of the dramatic changes from axial level to axial level asymmetry can cause.

In addition to evaluating the fluids in the formation, the fluids in the borehole are also of interest. As the degree of deviation of a well builds, there is a proportional increase in the likelihood of cuttings bed build-up in the well bore due to the effects of gravity. Cuttings beds have an adverse impact on the cuttings transport and the downhole pressure. Monitoring cuttings transport has been the subject of much research and has a direct impact on how specific well sections ought to be drilled. Gravity also has additional effects on mud mixtures in deviated wells. Particles in suspension in the mud (for instance barite), can fall out of suspension, and the mud mixture on the high side of the hole, can have different properties than the mud mixture on the low side of the hole. Therefore, if the cuttings and other materials are not maintained in suspension, the cuttings and other materials will rest on the low side of the hole, and the mud mixture, the cuttings and other materials will not be azimuthally homogeneously distributed across the borehole.

Currently, the borehole fluid ("drilling mud" or "mud") is characterized at the surface and its properties are extrapolated to conditions downhole. Factors such as temperature, pressure, and mud composition can vary in both space and time along the borehole. In addition, new mud formulations are continually evolving in the industry.

U.S. Pat. No. 3,688,115, issued to Antkiw, discloses a fluid density measuring device for use in producing oil wells. Density is determined by forcing the well fluid to pass through a chamber in the device. The fluid attenuates a beam of gamma radiation that traverses the chamber, the relative changes in the beam intensity providing a measure of the density in question. Streamlined surfaces and passageways leading into and out of the chamber eliminate turbulent flow conditions within the measuring chamber and thereby establish the basis for a substantially more accurate log of the production fluid density.

U.S. Pat. No. 4,297,575, issued to Smith et al., discloses a method for simultaneously measuring the formation bulk density and the thickness of casing in a cased well borehole. Low energy gamma rays are emitted into the casing and formation in a cased borehole. Two longitudinally spaced detectors detect gamma rays scattered back into the borehole by the casing and surrounding earth materials. The count rate signals from the two detectors are appropriately combined according to predetermined relationships to produce the formation bulk density and the casing thickness, which are recorded as a function of borehole depth.

U.S. Pat. No. 4,412,130, issued to Winters, discloses an apparatus for use within a well for indicating the difference in densities between two well fluids. The apparatus, for use with measurement-while-drilling (MWD) systems, is formed within a drill collar with a source of radiation removably disposed in a wall of the drill collar. At least two radiation detectors are located equidistant from the source of radiation with one detector adjacent an interior central bore through the drill collar and a second detector is adjacent the exterior of the drill collar. Two fluid sample chambers are spaced between the source of radiation and the detectors, respectively; one chamber for diverting fluid from the bore and the other chamber for diverting fluid from the annular space between the drill bore and the drill collar. Suitable circuitry is connected to the detectors for producing a differential signal substantially proportional to the difference in radiation received at the two detectors. The difference in the density between fluid passing through the drill collar and returning through the annular space is detected and indicated by the apparatus for early detection and prevention of blowouts.

U.S. Pat. No. 4,492,865, issued to Murphy et al., discloses a system for detecting changes in drilling fluid density downhole during a drilling operation that includes a radiation source and detector which are arranged in the outer wall of a drill string sub to measure the density of drilling fluids passing between the source and detector. Radiation counts detected downhole are transmitted to the surface by telemetry methods or recorded downhole, where such counts are analyzed to determine the occurrence of fluid influx into the drilling fluid from earth formations. Changes in the density of the mud downhole may indicate the influx of formation fluids into the borehole. Such changes in influx are determinative of formation parameters including surpressures which may lead to the encountering of gas kicks in the borehole. Gas kicks may potentially result in blowouts, which of course are to be avoided if possible. Hydrocarbon shows may also be indicative of producible formation fluids. The radiation source and detector in one embodiment of the system are arranged in the wall of the drill string sub to provide a direct in-line transmission of gamma rays through the drilling fluid.

U.S. Pat. No. 4,698,501, issued to Paske et al., discloses a system for logging subterranean formations for the determination of formation density by using gamma radiation. Gamma ray source and detection means are disposed within a housing adapted for positioning within a borehole for the emission and detection of gamma rays propagating through earth formations and borehole drilling fluid. The gamma ray detection means comprises first and second gamma radiation sensors geometrically disposed within the housing the same longitudinal distance from the gamma ray source and diametrically opposed in a common plane. A formation matrix density output signal is produced in proportion to the output signal from each of the gamma ray sensors and in conjunction with certain constants established by the geometrical configuration of the sensors relative to the gamma ray source and the borehole diameter. Formation density is determined without regard to the radial position of the logging probe within the borehole in a measuring while drilling mode.

U.S. Pat. No. 5,144,126, issued to Perry et al., discloses an apparatus for nuclear logging. Nuclear detectors and electronic components are all mounted in chambers within the sub wall with covers being removably attached to the chambers. A single bus for delivering both power and signals extends through the sub wall between either end of the tool. This bus terminates at a modular ring connector positioned on each tool end. This tool construction (including sub wall mounted sensors and electronics, single power and signal bus, and ring connectors) is also well suited for other formation evaluation tools used in measurement-while-drilling applications.

U.S. Pat. No. 5,469,736, issued to Moake et al., discloses a caliper apparatus and a method for measuring the diameter of a borehole, and the standoff of a drilling tool from the walls of a borehole during a drilling operation. The apparatus includes three or more sensors, such as acoustic transducers arranged circumferentially around a downhole tool or drill collar. The transducers transmit ultrasonic signals to the borehole wall through the drilling fluid surrounding the drillstring and receive reflected signals back from the wall. Travel times for these signals are used to calculate standoff data for each transducer. The standoff measurements may be used to calculate the diameter of the borehole, the eccentricity of the tool in the borehole, and the angle of eccentricity with respect to the transducer position. The eccentricity and angle computations may be used to detect unusual movements of the drillstring in the borehole, such as sticking, banging, and whirling.

U.S. Pat. No. 5,473,158, issued to Holenka et al., discloses a method and apparatus for measuring formation characteristics as a function of angular distance segments about the borehole. The measurement apparatus includes a logging while drilling tool which turns in the borehole while drilling. Such characteristics as bulk density, photoelectric effect (PEF), neutron porosity and ultrasonic standoff are all measured as a function of such angular distance segments where one of such segments is defined to include that portion of a "down" or earth's gravity vector which is in a radial cross sectional plane of the tool. The measurement is accomplished with either a generally cylindrical tool which generally touches a down or bottom portion of the borehole while the tool rotates in an inclined borehole or with a tool centered by stabilizer blades in the borehole.

U.S. Pat. No. 6,032,102, issued to Wijeyesekera et al., discloses a method and an apparatus for determining the porosity of a geological formation surrounding a cased well. The method further comprises generating neutron pulses that irradiate an area adjacent the well, where neutrons are sensed at a plurality of detectors axially spaced apart from each other and a plurality of neutron detector count rates is acquired. A timing measurement is acquired at one of the spacings to measure a first depth of investigation. A ratio of the neutron detector count rates is acquired to measure a second depth of investigation. An apparent porosity is calculated using the timing measurements and the ratios of neutron count rates. The effect of a well casing on the calculated apparent porosity is determined in response to at least one of the ratio of neutron detector count rates and the timing measurement. A cement annulus is computed based on the ratios of neutron count rates and the timing measurement. A formation porosity is calculated by performing a correction to the apparent porosity for the casing and the cement annulus.

U.S. Pat. No. 6,167,348, issued to Cannon, discloses a method for ascertaining a characteristic of a geological formation surrounding a wellbore. The method comprises first generating a set of data including azimuthal and radial information. A set of parameters indicative of fluid behavior in the formation is determined for each one of at least two azimuths from the generated data. A tool-specific invasion factor is then determined. The characteristic is then determined from the parameters, the azimuthal information, and the invasion factor.

U.S. Pat. No. 6,176,323, issued to Weirich et al., discloses a drilling system for drilling oilfield boreholes or wellbores utilizing a drill string having a drilling assembly conveyed downhole by a tubing (usually a drill pipe or coiled tubing). The drilling assembly includes a bottom hole assembly (BHA) and a drill bit. The bottom hole assembly preferably contains commonly used measurement-while-drilling sensors. The drill string also contains a variety of sensors for determining downhole various properties of the drilling fluid. Sensors are provided to determine density, viscosity, flow rate, clarity, compressibility, pressure and temperature of the drilling fluid at one or more downhole locations. Chemical detection sensors for detecting the presence of gas (methane) and $H_2S$ are disposed in the drilling assembly. Sensors for determining fluid density, viscosity, pH, solid content, fluid clarity, fluid compressibility, and a spectroscopy sensor are also disposed in the BHA. Data from such sensors may is processed downhole and/or at the surface. Corrective actions are taken at the surface based upon the downhole measurements, which may require altering the drilling fluid composition, altering the drilling fluid pump rate or shutting down the operation to clean wellbore. The drilling system contains one or more models, which may be stored in memory downhole or at the surface. These models are utilized by the downhole processor and the surface computer to determine desired fluid parameters for continued drilling. The drilling system is dynamic, in that the downhole fluid sensor data is utilized to update models and algorithms during drilling of the wellbore and the updated models are then utilized for continued drilling operations.

U.S. Pat. No. 6,220,371, issued to Sharma et al., discloses a method and apparatus for real time in-situ measuring of the downhole chemical and or physical properties of a core of an earth formation during a coring operation. The method and apparatus comprise several embodiments that may use electromagnetic, acoustic, fluid and differential pressure, temperature, gamma and x-ray, neutron radiation, nuclear magnetic resonance, and mudwater invasion measurements to measure the chemical and or physical properties of the core that may include porosity, bulk density, mineralogy, and fluid saturations. There is a downhole apparatus coupled to an inner and or an outer core barrel near the coring bits with a sensor array coupled to the inner core barrel for real time gathering of the measurements. A controller coupled to the sensor array controls the gathering of the measurements and stores the measurements in a measurement storage unit coupled to the controller for retrieval by a computing device for tomographic analysis.

There remains a need for a technique to measure the properties of the formation and borehole fluid downhole with a single tool in order to detect kicks, cuttings bed build-up, or other problems with the borehole fluid. As applied to LWD, such a technique preferably takes advantage of the tool's rotation while drilling to scan the formation/mud environment.

SUMMARY OF INVENTION

A method is disclosed for determining a characteristic of a mud mixture surrounding a drilling tool within an inclined borehole in which a drilling tool is conveyed. The method includes defining a cross-section of the tool which is orthogonal to a longitudinal axis of the tool. A bottom contact point of the cross-section of the tool is determined, which contacts the inclined borehole as the tool rotates in the borehole. The cross-section is separated into at least two segments, where one of the segments is called a bottom segment of the borehole which includes the bottom contact point of the cross-section of the tool with the inclined borehole. The tool is turned in the borehole. Energy is applied into the borehole from an energy source disposed in the tool, as the tool is turning in the borehole. Measurement signals are received at one or more sensors disposed in the tool from circumferentially spaced locations around the borehole, where the measurement signals are in response to returning energy which results from the interaction of the applied energy with the mud mixture and the formation. The measurement signals are associated with a particular segment during the time such signals are produced in response to energy returning from the mud mixture and the formation, depending on the sensor's geometry and spacing and the kind of energy produced, because the geometry, spacing, and energy type will affect the depth of investigation of the energy produced, as the tool is turning in the borehole. An indication of a characteristic of the mud mixture, substantially free of the effects of the formation, is derived as a function of the measurement signals associated with a plurality of the at least two segments of the borehole. The indications of a characteristic of the mud mixture for the plurality of segments are compared with at least one of each other and a known indication of a characteristic of the mud mixture.

Other aspects and advantages of the invention will be apparent from the following description and the appended claims.

BRIEF DESCRIPTION OF DRAWINGS

The invention may be understood by reference to the following description taken in conjunction with the accompanying drawings, in which like reference numerals identify like elements, and in which:

FIG. 4A illustrates a cross sectional view taken along line 4—4 of FIG. 1 showing a generally cylindrical (not stabilized) tool rotating in an inclined borehole, where the borehole has been divided into four equal length angular distance segments (quadrants) and where the sensor is in a down or bottom position;

FIG. 4B illustrates a similar cross sectional view as that of FIG. 4A but shows a LWD tool with stabilizing blades such that there is substantially no difference in standoff from the cylindrical portion of the tool to the borehole wall as the tool rotates, and also further showing an example of heterogeneous formations with the borehole having one formation on one side and another formation on the other side, where the borehole may be inclined or substantially vertical;

FIG. 5A schematically illustrates magnetometers and accelerometers placed along x, y and z axes of a MWD tool, with a computer accepting data from such instruments to produce an instantaneous angle phi between a vector H' of H x and H y and a vector G' of G x and G y;

FIG. 5B illustrates a cross section of the MWD tool showing the angle phi as measured from the H' vector which is constant in direction, but with time has different x and y coordinates while the MWD tool rotates in the borehole;

FIG. 6A is an illustration of the magnetometer section and Quadrant/Sensor Position Determination computer program of the electronics module of FIGS. 3A and 3B, such illustration showing the determination of the angle theta of the vector H' in terms of the H x and H y signals from the magnetometers in the electronics module, and further showing the determination of the angle of a down vector D as a function of theta (t) and the angle phi transferred from the MWD tool, such illustration further showing the determination of quadrants as a function of the angle of the down vector, and such illustration further showing the determination of which quadrant that a sensor is in as it rotates in a borehole;

FIGS. 6B–6E illustrate angles from the x and y axes of the LWD tool and from the sensors to the H vector as the LWD tool is turning as a function of time in the borehole;

FIG. 6F illustrates dividing the borehole into four segments, where a bottom segment or quadrant is defined about the down vector D;

FIGS. 10A-1 and 10A-2 illustrate a computer program of the LWD computer for determining rotational density output and DELTA rho ROT correction factors;

FIGS. 10D-1 and 10D-2 illustrate an example of the entire borehole distribution of the number of samples as a function of count rate for the inclined hole of FIG. 10B and for an expected distribution of count rates for a circular borehole, and by way of illustration for a particular quadrant Q TOP, the method of determining DELTA rho ROT, and rho b ROT for the entire borehole and for each quadrant;

FIGS. 12D–F illustrate an alternative computer program which may be used in the LWD computer for determining rotational photoelectric effect (PEF) outputs for the entire borehole and for each quadrant;

DETAILED DESCRIPTION

Figure 1:
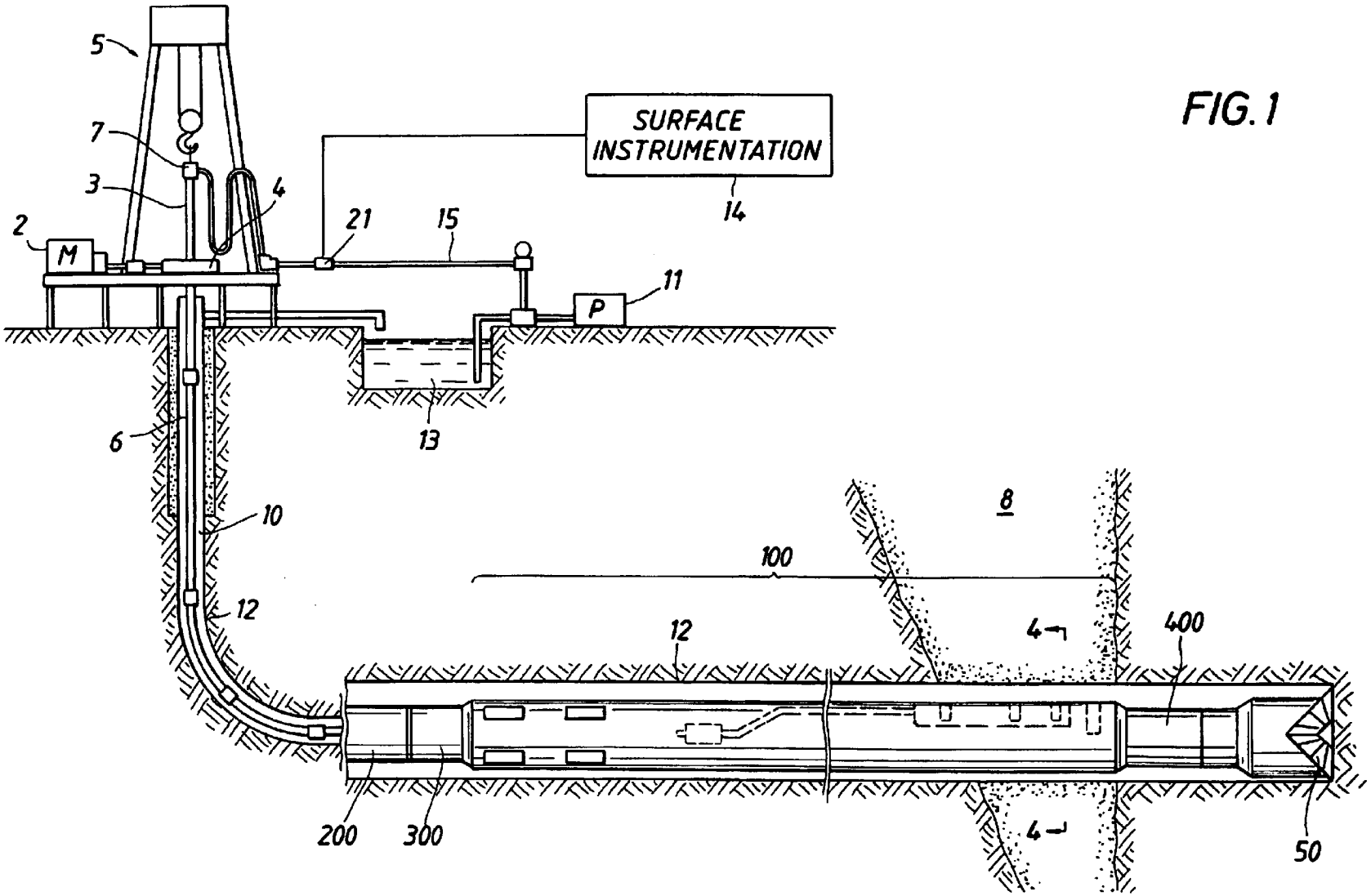
FIG. 1 is a schematic illustration of a downhole logging while drilling (LWD) tool connected in tandem with other measuring while drilling (MWD) tools above a drill bit at the end of a drill string of an oil and gas well in a section of the well which is substantially horizontal.

Introduction:

FIG. 1 illustrates a logging while drilling (LWD) tool 100 connected in tandem with a drilling assembly including drill bit 50. An associated downhole electronics module 300 and MWD tool 200 including magnetometers and accelerometers are also connected in tandem with LWD tool 100. Module 300 may be a separate "sub" or it may be disposed in the body of LWD tool 100. A communication sub 400 may also be provided as illustrated in the drilling assembly.

The LWD tool 100 is shown for illustration purposes as being in an inclined portion of a borehole at the end of a drill string 6 which turns in a borehole 12 which is formed in formation 8 by penetration of bit 50. A drilling rig 5 turns drill string 6. Drilling rig 5 includes a motor 2 which turns a kelly 3 by means of a rotary table 4. The drill string 6 includes sections of drill pipe connected end-to-end to the kelly 3 and turned thereby. The MWD tool 200, electronics module 300, and the LWD tool 100 and communication sub 400 are all connected in tandem with drill string 6. Such subs and tools form a bottom hole drilling assembly between the drill string 6 of drill pipe and the drill bit 50.

As the drill string 6 and the bottom hole assembly turn, the drill bit 50 forms the borehole 12 through earth formations 8. In one embodiment, drilling fluid or "mud" is forced by pump 11 from mud pit 13 via stand pipe 15 and revolving injector head 7 through the hollow center of kelly 3 and drill string 6, and the bottom hole drilling assembly to the bit 50. Such mud acts to lubricate drill bit 50 and to carry borehole cuttings or chips upwardly to the surface via annulus 10. In another embodiment, drilling fluid or "mud" is forced by pump 11 from mud pit 13 via stand pipe 15 and revolving injector head 7 through the annulus 10 to the bit 50, the mud returns through the bit 50, the bottom hole drilling assembly, through the drill string 6, and to the hollow center of kelly 3. The mud is returned to mud pit 13 where it is separated from borehole cuttings and the like, degassed, and returned for application again to the drill string 6.

The communication sub 400 receives output signals from sensors of the LWD tool 100 and from computers in the downhole electronics module 300 and MWD tool 200. Such communications sub 400 is designed to transmit coded acoustic signals representative of such output signals to the surface through the mud path in the drill string 6 and downhole drilling assembly. Such acoustic signals are sensed by transducer 21 in standpipe 15, where such acoustic signals are detected in surface instrumentation 14. The communication sub 400, including the surface instrumentation necessary to communicate with it, are arranged as the downhole and surface apparatus disclosed in U.S. Pat. Nos. 4,479,564 and 4,637,479. The communication sub 400 may include the communication apparatus disclosed in U.S. Pat. No. 5,237,540.

Figures 2, 3A:
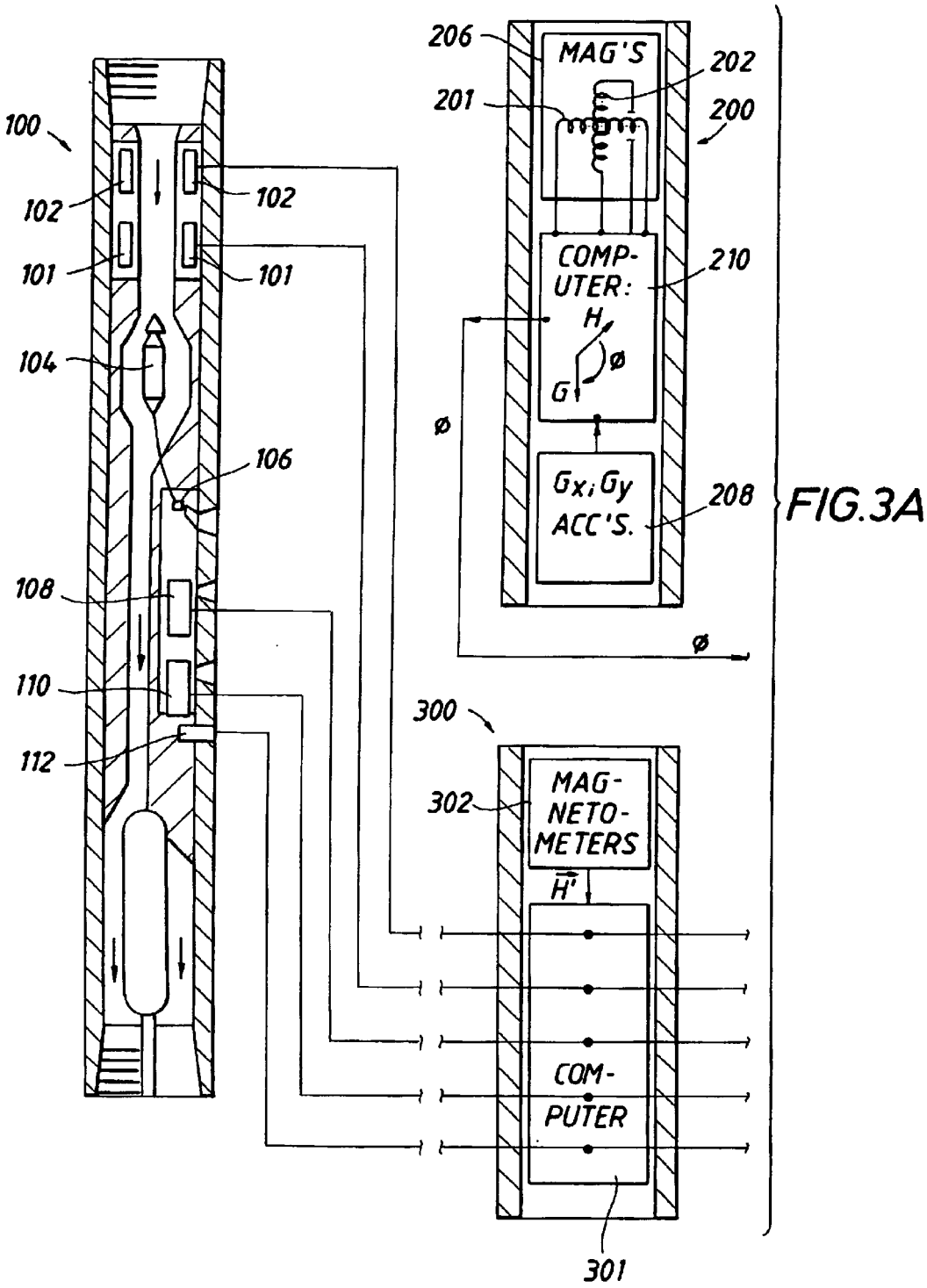
FIG. 2 is a schematic longitudinal cross section of the LWD tool which can be used in a method according to the invention, illustrating a neutron source and neutron detectors, a gamma ray source and gamma ray detectors and an ultrasonic detector, producing formation neutron data, formation gamma ray data and ultrasonic signal data, respectively.
FIG. 3A is a schematic longitudinal cross section of one embodiment of a separate MWD tool having magnetometers and accelerometers placed along orthogonal x and y axes of such tool and a computer for generally continuously or periodically (e.g., at survey times while the drill string is not turning) determining an angle phi between an H vector and a G vector in a plane of such x and y axes; and further schematically illustrates a downhole electronics module associated with the LWD tool, the illustration showing orthogonal magnetometers placed along x and y axes which are in a plane parallel to the plane of the corresponding axes in the MWD tool.

LWD Tool:

FIG. 2 is a schematic view of the LWD tool 100. The physical structure of the LWD tool body and associated sensors may be like those described in U.S. Pat. No. 4,879,463 to Wraight, et al., U.S. Pat. No. 5,017,778 to Wraight, and U.S. Pat. No. 5,473,158 to Holenka, et al. Those patents describe a logging while drilling tool, specifically a compensated density neutron tool used in logging while drilling measurements of formation characteristics. Other optional equipment of the LWD tool 100 may include: (1) an ultrasonic sensor 112 that is added to the assembly and (2) stabilizer blades. The addition of stabilizer blades is an alternative embodiment of the LWD tool 100 as shown in FIG. 4B, where a stabilized tool is used with methods of the invention as described below.

The LWD tool 100 includes a source of neutrons 104, and near and far spaced neutron detectors 101, 102 at axially spaced locations from the source 104. It may also include a source of gamma rays 106 and short and long spaced gamma ray detectors 108, 110. LWD tool 100 may also include an ultrasonic transducer 112 for measuring tool standoff from the borehole wall. Such ultrasonic transducer and system is described in U.S. Pat. No. 5,130,950 issued to Orban, et al.

In one embodiment, the number of sources (neutron, gamma ray, and/or ultrasonic) may be varied according the operating environment. In an alternative embodiment, the tool 100 need not necessarily be mounted to drill string 6 and might simply be dropped into the wellbore 12 during a cessation in drilling activities. In another embodiment, the tool 100 may carry a plurality of each type of source arranged radially about the tool 100, so that the tool 100 might not need to be rotated. In another embodiment, there are provided multiple, separate tools (not shown), each carrying only one type of source with appropriate receivers, might be deployed instead of a single tool 100 carrying all of the sources and receivers.

In another embodiment, the tool 100 has a placement of detectors and the ability to determine tool orientation, such that measurements of count rates, spectra, and tool angle with respect to gravity, for example, can be obtained which can be analyzed to yield mud and formation properties. In another embodiment, a WL or LWD tool is provided that makes at least one measurement with a depth of investigation comparable to or smaller than the difference between the nominal borehole diameter and the outer diameter of the tool. This measurement may also be focused azimuthally to within at least 180 degrees. In another embodiment, the tool may be run off-center within the borehole and have a known orientation, determined either by measuring its orientation dynamically or by other means known in the art.

In one embodiment, the tool 100 can make a shallow, focused measurement collected when the spatial region to which the measurement is sensitive largely overlaps the mud crescent. This measurement is mainly correlated with the mud properties. In another embodiment, data may be collected when the sensitive region largely overlaps the formation and would be mainly correlated with the formation properties. In another embodiment, the tool 100 may make both kinds of measurements. The data collected from these measurements may be obtained simultaneously from different detectors or sequentially by changing the orientation of the tool deliberately or as a by-product of rotation. The tool may make additional measurements that are not necessarily shallow or focused. The data from all measurements may be combined with knowledge of the tool response to then accurately yield the properties of both mud and the formation. Properties of both mud and the formation that may be measured include density, photoelectric factor, hydrogen index, and salinity.

In one embodiment, the tool 100 is an Azimuthal Density Tool ADN825 (Trademark of Schlumberger) tool. This tool is a slick-collar nuclear LWD tool generally used in deviated boreholes drilled with large bits. Neutrons are produced from a centrally mounted chemical AmBe source and diffuse into the surrounding mud and formation. Some fraction of these neutrons return and are detected in one or both of two banks, distinguished by their distances to the source along the tool axis ("near" and "far") and by the detector configurations in each bank. The near bank comprises two unshielded $^3$He detectors which are mainly sensitive to thermal neutrons. These detectors flank a $^3$He detector shielded with cadmium, rendering it sensitive primarily to epithermal neutrons. The far bank comprises five unshielded $^3$He thermal neutron detectors. The three central far detectors may be coaxial with the three near detectors. Other materials may be used for shielding one or more of the detectors as known in the art. In another embodiment, the shielding may be omitted under certain source-detector spacings and configurations. In another embodiment, the ADN825 tool 100 may also contain a gamma ray section, which generally consists of a gamma ray source and two gamma ray detectors close to (short-spaced detector) and farther from (long-spaced detector) the source. The depth of investigation of the corresponding measurement is shallow compared to the depth of the mud crescent and is even more focused than the neutron measurement. Consequently, gamma-ray data collected when the tool is in the up and down quadrants can be used to determine density and photoelectric factor of both formation and mud in a manner similar to that described above for the neutron measurement. In another embodiment, the techniques of using the tool 100 allow for the economical use of a single set of detectors to measure both mud and formation properties.

Figure 3B:
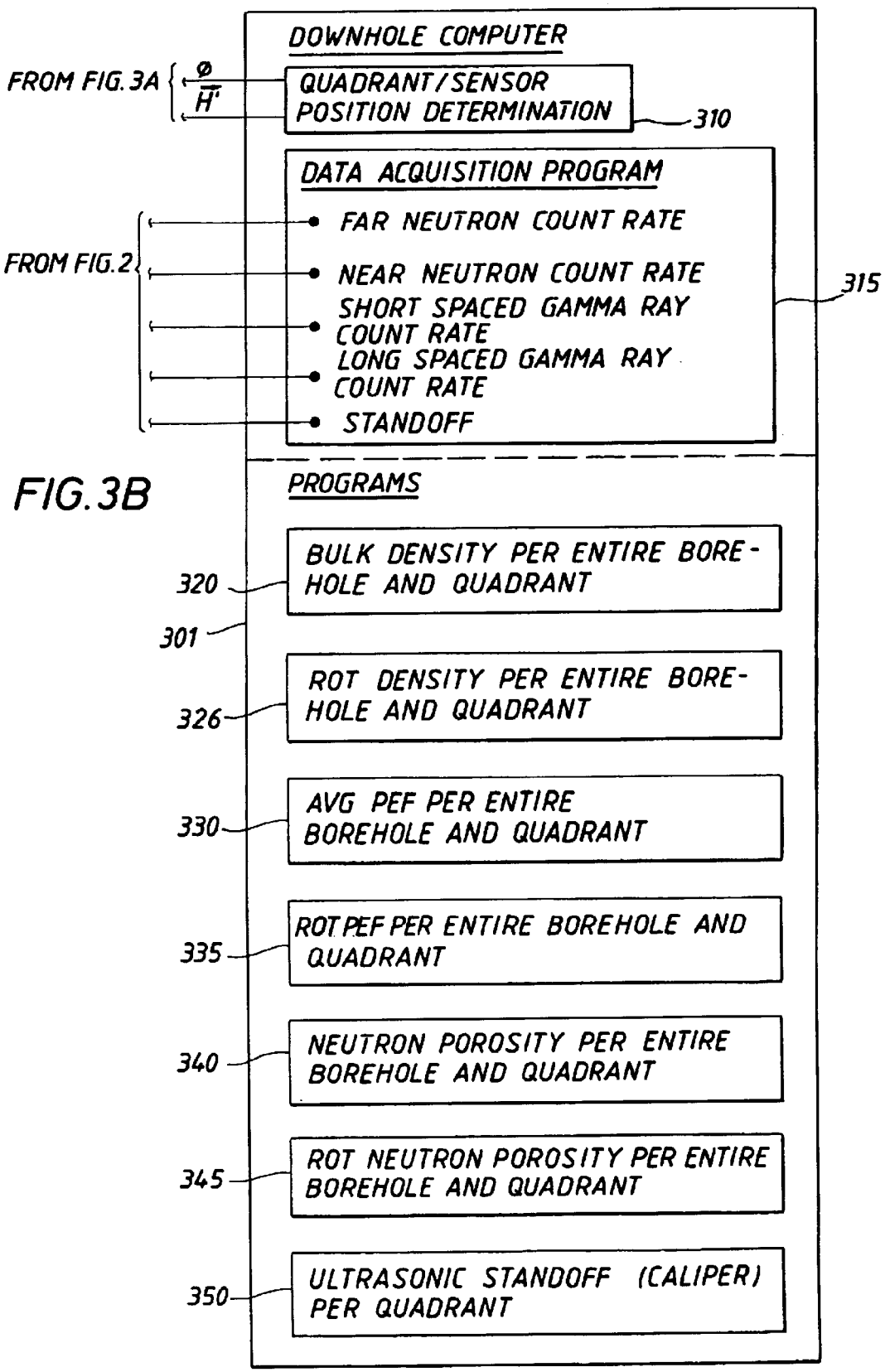
FIG. 3B is a schematic illustration of computer programs in a downhole computer for determining borehole quadrants, sensor position, and for determining bulk density and rotational density, average PEF and rotational PEF, neutron porosity and rotational neutron porosity for the entire borehole and each quadrant, and ultrasonic standoff for each quadrant.

MWD Tool:

A MWD tool 200 may be provided in the bottom hole drilling assembly as schematically indicated in FIG. 1. FIG. 3A schematically illustrates that MWD tool 200 includes magnetometers 201,202 oriented along x and y axes of the tool. Such x and y axes are in the plane of a radial cross section of the tool. A z axis of the tool is oriented along its longitudinal axis. In a similar way, accelerometers $G_x$ and $G_y$ of accelerometer package 208 (which also includes an accelerometer along the z axis of the tool) are oriented along the x and y axes of the tool. A microcomputer 210 responds to $H_y$ and $H_x$ signals (from the magnetometers 201, 202) and $G_x$ and $G_y$ signals (from the accelerometer package 208) to constantly determine an angle phi between an H' vector and the G' vector, in the cross sectional plane of MWD tool 200. The H' vector represents that portion of a vector pointed to earth's magnetic north pole which is projected onto the x-y plane of MWD tool 200. The G' vector represents the down component in the cross sectional plane of MWD tool 200, of the earth's gravity vector. As illustrated in FIG. 3B, a signal representative of such angle phi (ϕ) is constantly communicated to downhole computer 301 of electronics module 300. Its use in determining a down vector of electronics module 300 and LWD tool 100 is described in the description of a Quadrant/Sensor Position Determination computer program 310 presented below.

Electronics Module:

The electronics module 300 (which may be part of MWD tool 200 or an independent sub) of FIG. 3A includes a magnetometer section 302 and a microcomputer 301. The x and y axes, on which magnetometers of the magnetometer section 302 are oriented, are in a plane which is substantially parallel with the plane of such axes of the MWD tool 200. Accordingly, the H vector generated by the magnetometer section 302 of electronics module 300 is substantially the same vector H determined by computer 210. Accordingly, the computer program 310 has information to determine the down vector angle with respect to a sensor vector as a function of time. A more detailed description of such determination is presented below.

Electronics module 300 receives data from near and far spaced neutron detectors 101 and 102, short and long spaced gamma ray detectors 108, 110 and ultrasonic transducer 112. Ultrasonic transducer 112 is angularly aligned with gamma ray detectors 108, 110 and with gamma ray source 106.

As illustrated in FIG. 3B, downhole computer 301 may include not only the Quadrant/Sensor Position Determination program 310, but also may include a data acquisition program 315, a bulk density program 320, a rotational density per entire borehole and per quadrant program 326, an average photoelectric effect (PEF) program 330, a rotational PEF program 335, a neutron porosity program 340, a rotational neutron porosity program 345, and an ultrasonic standoff program 350, and others. Such programs may transfer data signals among themselves in certain cases, as described below.

Determination of Down Vector, Angular Distance Segments and Angular Position of Sensors:

Determination of Down Vector D with respect to x, y axes:

FIGS. 5A, 5B, and 6A–F illustrate the determination of a down vector in computer 301 (FIG. 3B). FIG. 4A shows the case of an unstabilized LWD tool 100 which, in an inclined borehole, generally constantly touches the bottom of the borehole. FIG. 4B illustrates the case of a stabilized LWD tool 100'.

FIG. 5A illustrates the magnetometers H and the accelerometers G oriented along x, y and z axes of the MWD tool 200. As explained above, an angle phi (ϕ) is constantly computed between the H' vector (a constantly directed vector, in the x-y plane for the H directed vector to earth's magnetic pole) and a G' vector (a constantly directed down vector, in the x-y plane of a vector G directed to the earth's gravitational center, i.e., the center of the earth). As FIG. 5B illustrates, MWD tool 200 is rotating in borehole 12. The x and y axes of the tool 200 are rotating at the angular speed of the drilling string, e.g., from about 30 to about 200 revolutions per minute, so the x and y components of the H' vector and the G' vector are constantly changing with time. Nevertheless, the H' and the G' vectors point generally in constant directions, because the borehole direction changes slowly with time during the time that it is being drilled through subterranean rock formations.

FIG. 6A illustrates the magnetometer section 302 of electronics module 300. Magnetometers $H_x$ and $H_y$ are oriented along x and y axes of the electronics module 300. Such x and y axes are in a plane which is substantially parallel with the plane of such axes of MWD tool 200. Accordingly, the $H_x$ and $H_y$ signals transmitted from magnetometer section 302 to computer 301 and computer program 310 are used to form a constantly directed reference with respect to an axis of the module, e.g., the x axis.

As FIGS. 6A–6E illustrate, as the MWD tool 200 rotates in borehole 12, an angle theta (θ) is constantly formed between the tool x axis and such H' vector. The angle theta (θ) is determined from the $H_x$ and $H_y$ signals from magnetometer section 302 of electronics module 300:

Next, the down vector angle, angle D(t) is determined in Quadrant/Sensor Position $$\Theta(t)=\cos^{-1}[H_x(t)/\{H_x(t)^2+H_y(t)^2\}^{0.5}]$$

by determination program 310 (in FIG. 6A), as a function of the x and y axes and time, by accepting the angle phi from the MWD tool 200. The angle of the down vector is determined in program 310 as, $$\text{angle}_{D(t)}=\Theta(t)-\phi$$

Four quadrants may be defined by angular ranges about the periphery of the tool:

$$Q_{BOT}(t)=\text{angle } D(\text{I})-45° \text{ to angle } D(t)+45°,$$

$$Q_{LEFT}(t)=\text{angle } D(t)+45° \text{ to angle } D(t)+135°,$$

$$Q_{TOP}(t)=\text{angle } D(t)+135° \text{ to angle } D(t)+225°,$$

$$Q_{RIGHT}(t)=\text{angle } D(t)+225° \text{ to angle } D(t)-45°,$$

FIGS. 6B–E illustrate the position of MWD tool 200, electronics module 300, and LWD tool 100 in borehole 12 at several times, $t_1$, $t_2$, $t_3$, $t_4$ as it rotates. The angle theta (θ) varies with time, because it is measured from the x axis of the MWD tool 200 (and of the electronics module 300 and LWD tool 100) to the H vector. The angle phi (ϕ) is constant from the H' vector to the D vector.

Determination of Angular Distance Segments:

FIG. 6A further illustrates generation of angular distance segments around the borehole. The term "quadrant" is used to illustrate the invention where four ninety degree angular distance segments are defined around the 360° circumference of the MWD tool 200 or the LWD tool 100. Other angular distance segments may be defined, either lesser or greater in number than four. The angular distance of such segments need not necessarily be equal.

In one embodiment of the invention, quadrants are defined as illustrated in the computer program representation of the Quadrant/Sensor Position Determination program 310 (in FIG. 6A). A bottom quadrant $Q_{BOT}$ (t) is defined as extending forty-five degrees on either side of the down vector D(t). Left quadrant, $Q_{LEFT}$ (t), top quadrant, $Q_{TOP}$ (t) and right quadrant, $Q_{RIGHT}$ (t) are defined as in FIG. 6A, and can be seen in FIG. 6F.

Determination of Angular Position of Sensors:

As FIGS. 6B–E further illustrate, the sensors S (e.g., short and long spaced gamma ray detectors 108, 110, ultrasonic transducer 112 and near and far spaced neutron detectors 101, 102) are oriented at a known angle alpha (α) from the x axis. Thus, the angle of the sensor is a constant angle alpha (α) as measured from the x axis of the electronics module or sub 300. Accordingly, computer program 310 determines which quadrant a sensor is in by comparing its angle from the x axis with the quadrant definition with respect to the x axis. For example, sensors S are in $Q_{BOT}$ when alpha (α) is between (theta (θ)−ϕ−45°) and (theta (θ)−ϕ+45°). Sensors S are in $Q_{TOP}$ when alpha (α) is between (theta (θ)−ϕ−135°) and (theta (θ)−ϕ−225°).

FIG. 6F further illustrates the down vector D and four quadrants, $Q_{BOT}$, $Q_{RIGHT}$, $Q_{TOP}$, and $Q_{LEFT}$ which are fixed in space, but are defined as a function of time with the turning x and y axes of MWD tool 200.

Figure 7A:
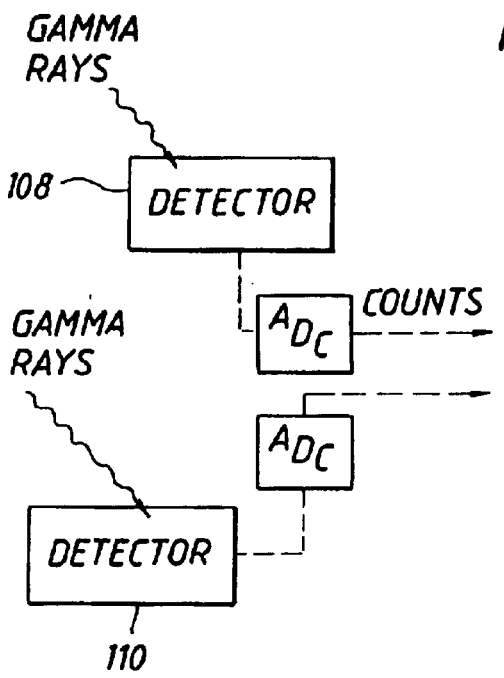
FIGS. 7A and 7B illustrate long and short spaced gamma ray detectors with apparatus for accumulating count rates in soft and hard energy windows.
Figure 7B:
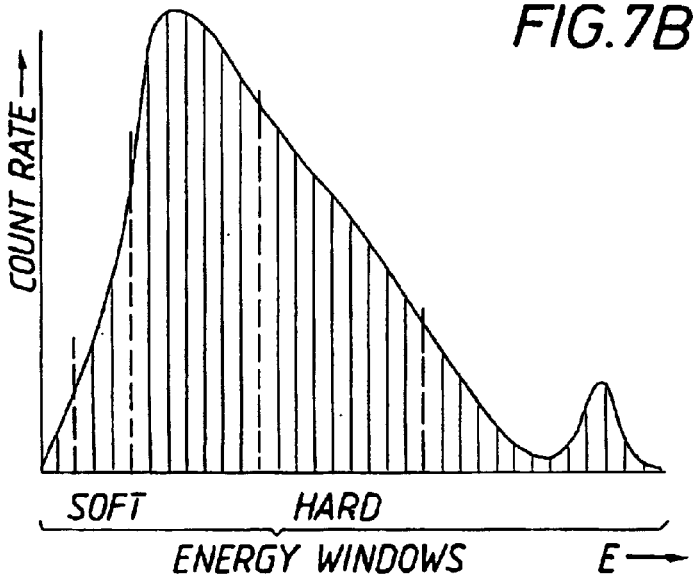

Determination of Bulk Density and Delta rho (Δρ) Correction Factors for Entire Borehole and for Quadrants:

Gamma Ray Data Acquisition by Energy Window, Time and by Quadrant:

FIG. 7A is a pictorial representation of gamma rays returning from the formation which are detected by gamma ray detectors. The detectors 108 and 110 produce outputs representative of the number of counts per energy window of the counts as reflected in the number and magnitude of the gamma rays detected by detectors 108, 110. Such outputs are directed to analog to digital devices (ADC's) and stored in the memory of downhole computer 301. An illustration of the storage of the rates of such counts, as a function of energy windows, is illustrated in FIG. 7B. Certain lower energy windows are designated "soft" windows. Certain higher energy windows are designated "hard" windows as illustrated in FIG. 7B.

Figure 8:
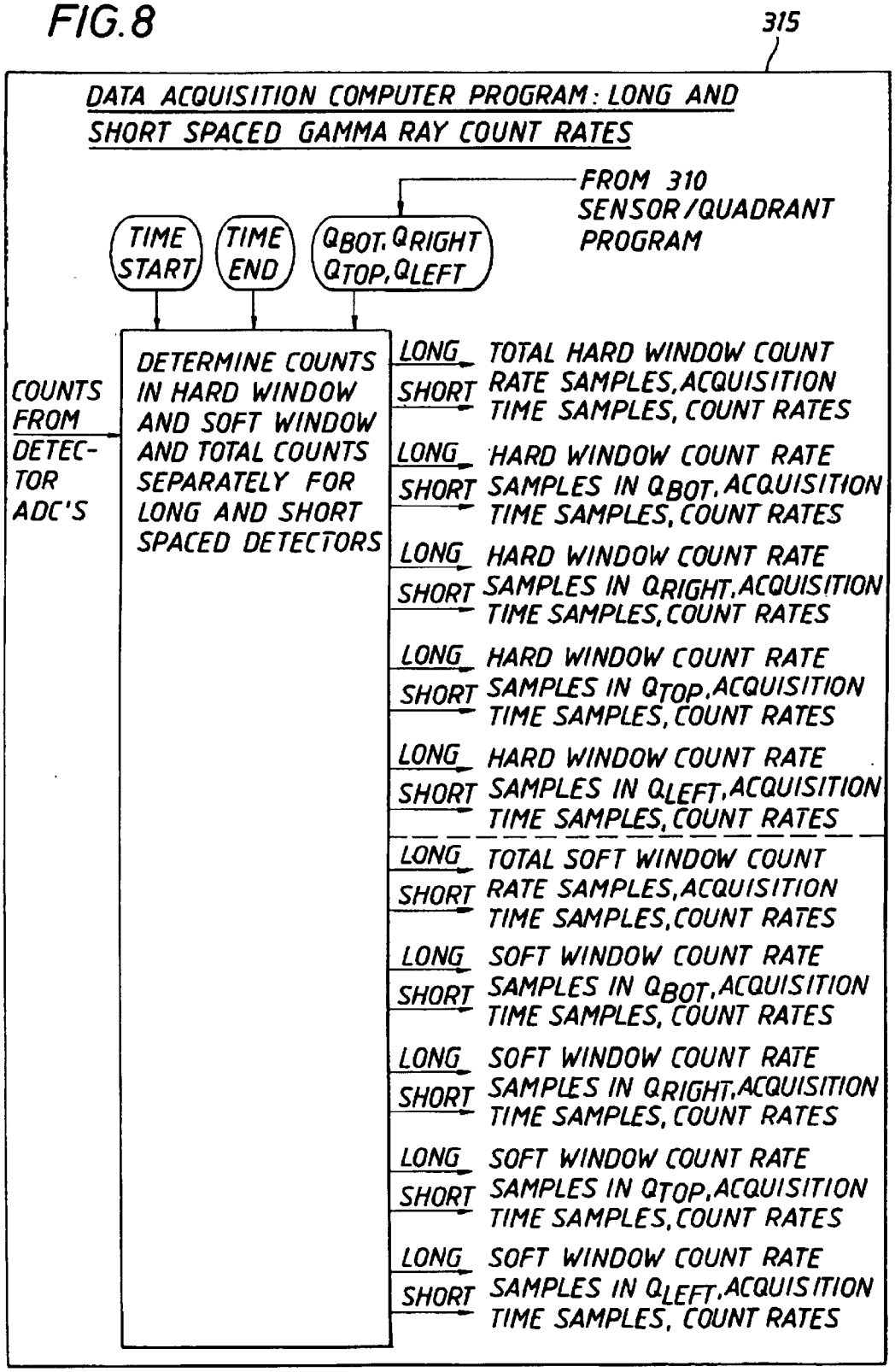
FIG. 8 illustrates a computer program of the LWD computer for determining the number of count rate samples per quadrant in hard windows and in soft windows as well as the total count rate samples for both the long and short spaced gamma ray detectors, acquisition time samples and count rates.

FIG. 8 illustrates that part of a data acquisition computer program 315 of computer 301 which accepts counts from the ADC's in response to detectors 108, 110. It also accepts starting times and end times for the accumulating of the total number of counts in each energy window for (1) the short spaced detector and (2) the long spaced detector as a function of the entire borehole and for each quadrant. The total acquisition time is also collected for the entire borehole, that is all counts, and for the acquisition time for each quadrant. Such outputs are for hard window counts as well as soft window counts. Computer program 315 also calculates count rates for all samples.

Figure 9:
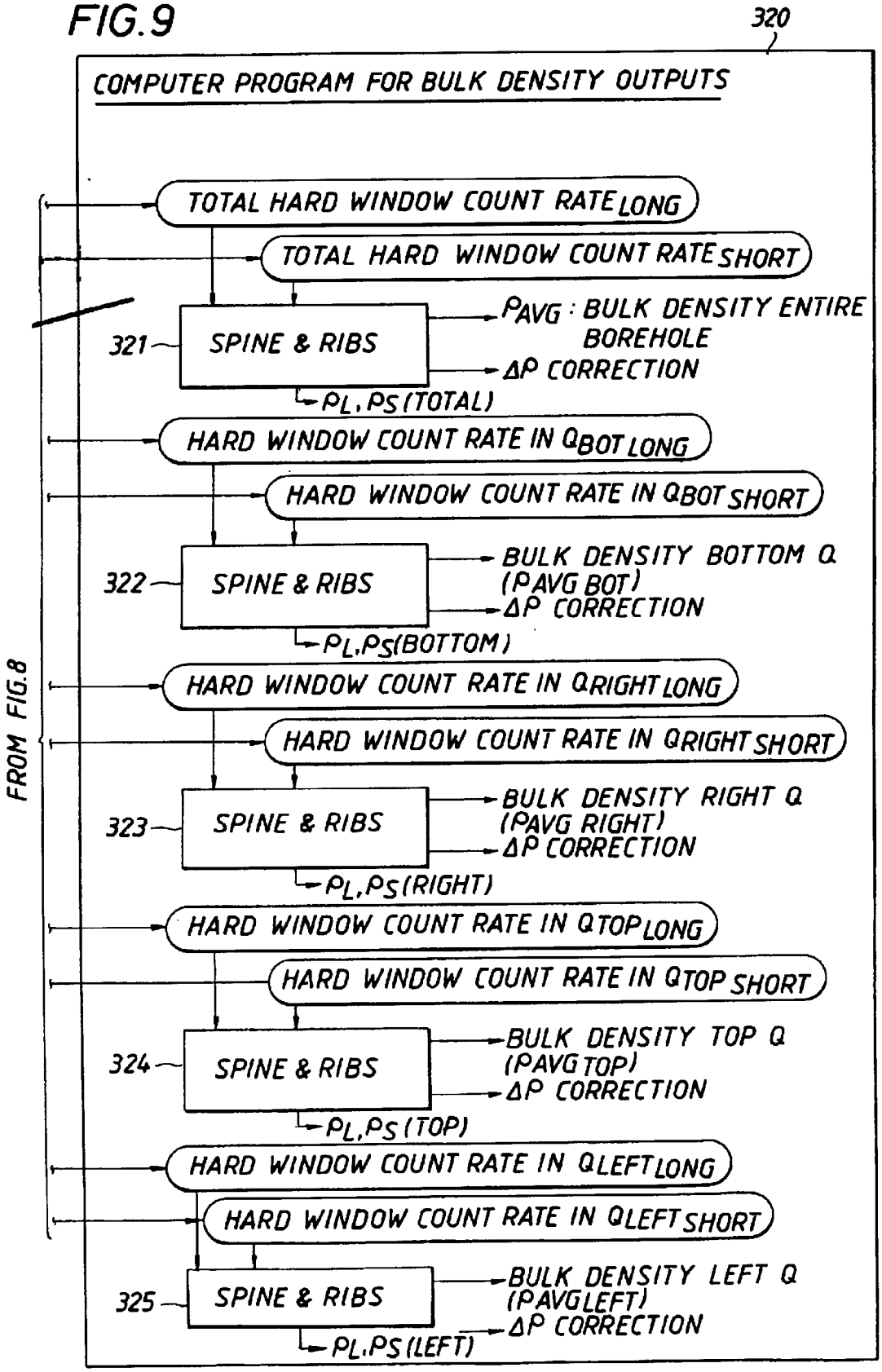
FIG. 9 illustrates a computer program of the LWD computer for determining the long and short spacing densities, the bulk density and DELTA rho correction factor determined by a spine and ribs technique for the entire borehole and for each of the bottom, right, top and left quadrants.

Bulk Density and Delta rho (Δρ) Correction Determination:

FIG. 9 illustrates computer program 320 of downhole computer 301 of electronics module 300 which accepts count rate signals of long and short spaced gamma ray detectors for hard window counts by angular distance segment (i.e., quadrant). Accordingly, as shown schematically in FIG. 9, a sub program 321, called "SPINE AND RIBS" receives digital data signals representative of the total hard window count rate for the entire borehole from both the long and short spaced detectors and determines long spacing density $\rho_L$, short spacing density $\rho_S$, bulk density $\rho_{AVG}$, and Δρ correction. A spine and ribs correction technique is well known in the nuclear well logging art of density logging. Such correction technique is based on a well known correction curve by Wahl, J. S., Tittman, J., Johnstone, C. W., and Alger, R. P., "The Dual Spacing Formation Density Log", presented at the Thirty-ninth SPE Annual Meeting, 1964. Such curve includes a "spine" which is a substantially linear curve relating the logarithm of long spacing detector count rates to the logarithm of short spacing detector count rates. Such curve is marked by density as a parameter along the curve. "Ribs" cross the spine at different intervals. Such ribs are experimentally derived curves showing the correction necessary for different mudcake conditions.

The spine and ribs computer program is repeated as at 322, 323, 324 and 325 to determine long spacing density $\rho_L$, short spacing density $\rho_S$, bulk density $\rho_{AVG}$, and Δρ correction for each quadrant based on the hard window count rates of the long and short spaced detectors for each quadrant.

Figures 1, 10A:
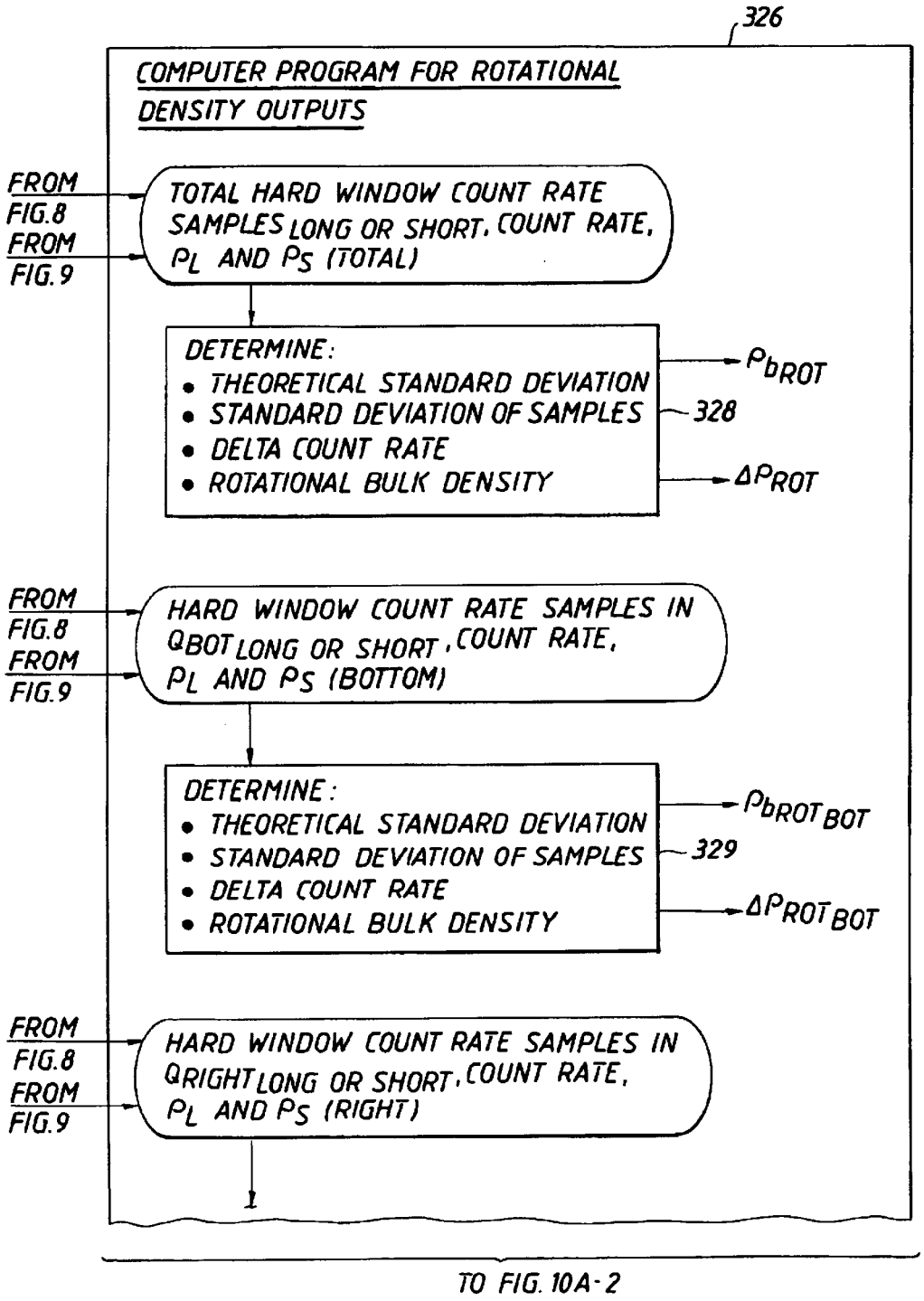
Figures 2, 10A:
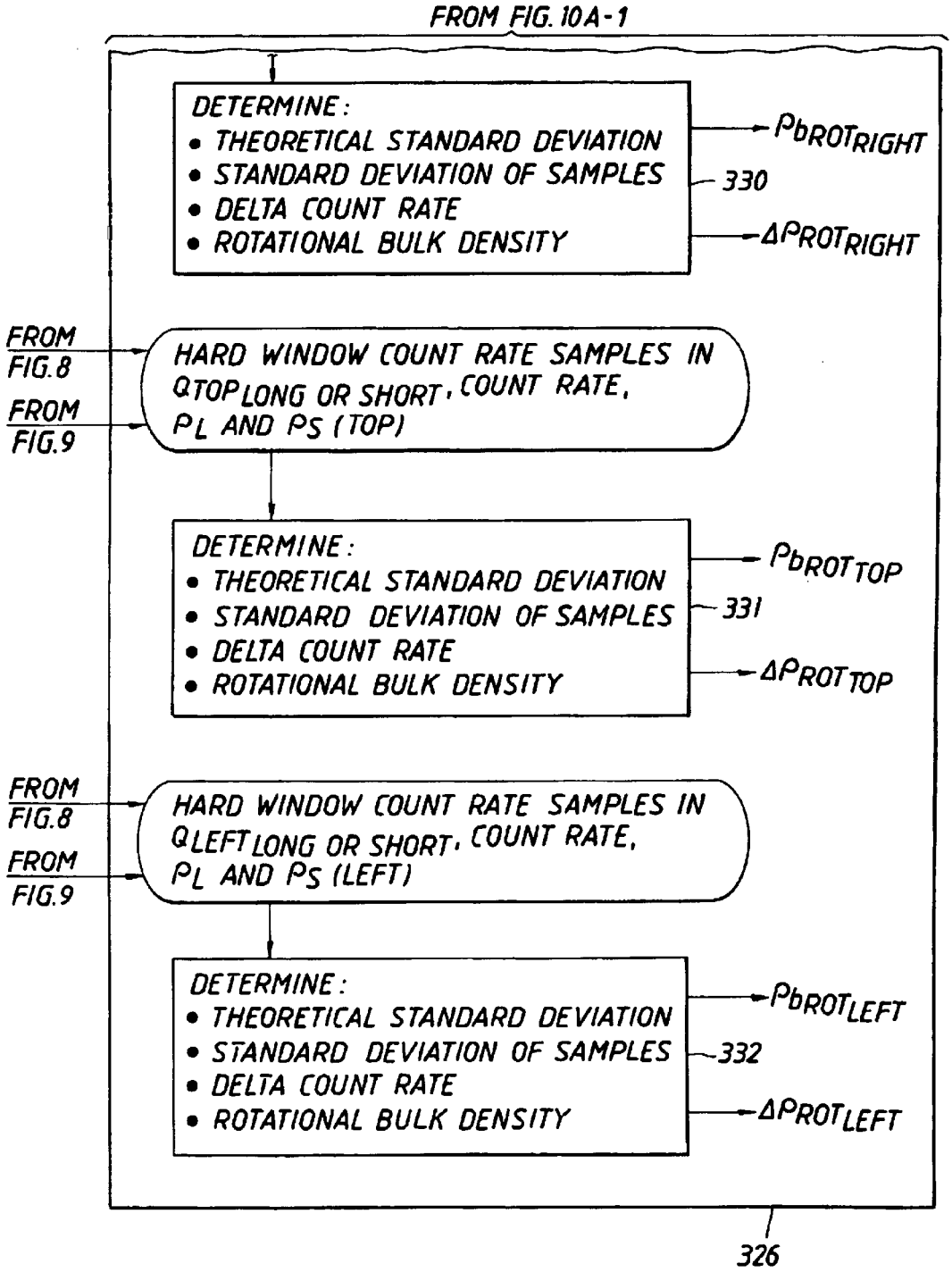
Figure 10B:
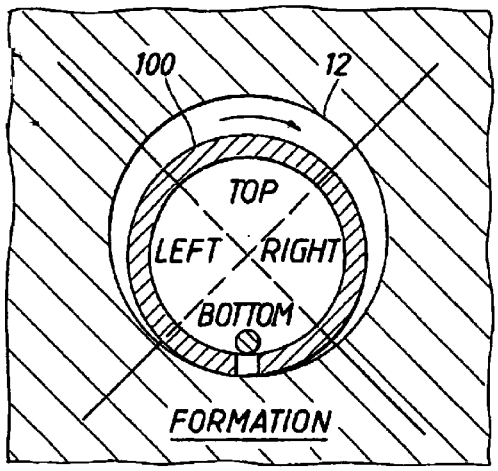
FIG. 10B illustrates a LWD tool rotating in an inclined borehole.

Determination of Rotational Density $\rho_{b\ ROT}$ and $\Delta\rho_{ROT}$ Correction for Entire Borehole and for Quadrants:

FIGS. 10A-1 and 10A-2 illustrate computer program 326 in downhole computer 301 which determines rotational density, called $\rho_{b\ ROT}$ and $\Delta\rho_{ROT}$ correction for each quadrant and for the entire borehole. Rotational density or rotational bulk density is borehole density corrected for borehole irregularity effects on the density measurement. The method is described for an entire borehole in U.S. Pat. No. 5,017,778 to Wraight. Such patent is also described in a paper by D. Best, P. Wraight, and J. Holenka, titled, AN INNOVATIVE APPROACH TO CORRECT DENSITY MEASUREMENTS WHILE DRILLING FOR HOLE SIZE EFFECT, SPWLA 31st Annual Logging Symposium, Jun. 24–27, 1990.

For the entire borehole, signals representing total hard window count rate samples from the long spaced or, alternatively, the short spaced gamma ray detector, and count rate are transferred from data acquisition computer program 315 (FIG. 8). Long and short spacing densities, PL and Ps, are transferred from computer program 320 (FIG. 9). A sub program 328 (See FIGS. 10A-1) determines a theoretical or circular hole standard deviation (or variance), determines a standard deviation of the measured samples of collected data, and determines a delta count rate, ΔCR, as a function of the variance between the measured standard deviation and the theoretical standard deviation of a circular hole. Next, a rotational bulk density digital signal $\rho_{b\ ROT}$ is determined. Digital signals representative of $\Delta\rho_{ROT}$ and $\rho_{b\ ROT}$ are output.

Figure 10C:
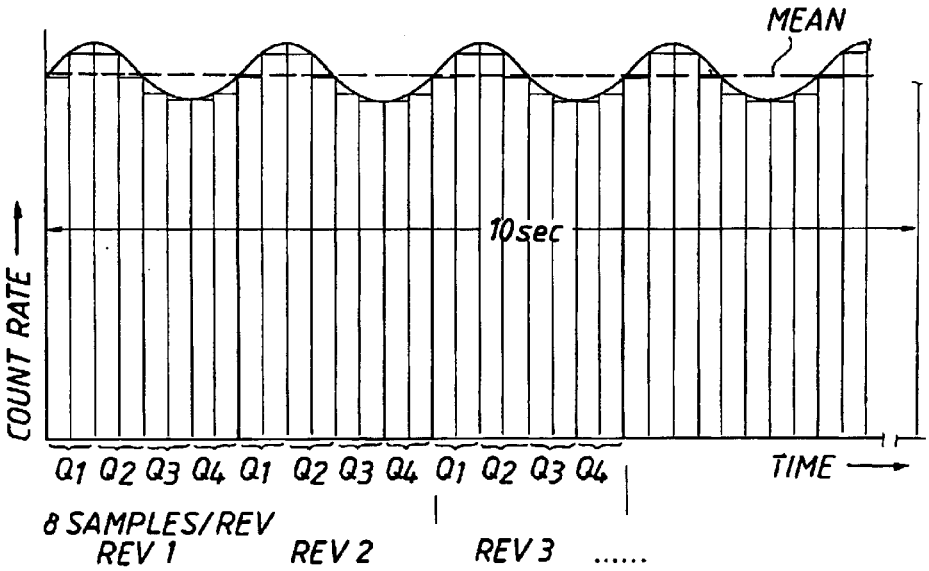
FIG. 10C illustrates count rates per quadrant where such count rates are fluctuating from quadrant to quadrant.

FIGS. 10B, 10C, 10D-1 and 10D-2 illustrate the method. FIG. 10B again shows an unstabilized LWD tool 100 rotating in borehole 12. FIG. 10C illustrates long spacing or, alternatively, short spacing hard window count rates of the LWD tool 100 as a function of time. As indicated in FIG. 1C, the time that the detector is in various quadrants (or angular distance segments referenced here as Q1, Q2 . . . ) is also shown. For a non-round hole, especially for a non-stabilized tool 100, the count rates fluctuate about a mean value for each revolution of the tool. In FIG. 10C, eight samples per revolution are illustrated. Data collection continues for 10 to 20 seconds.

FIGS. 10D-1 and 10D-2 illustrate the method of computer program 328 (see FIG. 10A-1) for determining $\rho_{b\ ROT}$ and $\Delta\rho_{ROT}$ for the entire borehole. First, a mean (average) and theoretical standard deviation ($\sigma_{theor}$) for a normal distribution from a circular borehole with a stabilized tool is estimated. Next, a histogram or distribution of the number of samples versus count rate measured (CR) is made and a mean and measured standard deviation ($\sigma_{meas}$) for all actual counts collected during an actual acquisition time is made. A delta count rate factor ΔCR is determined:

$$\Delta CR = A(\sigma^2_{meas} - \sigma^2_{theor})^{0.5}$$

where A is a constant which is a function of the data sampling rate.

Next the DELTA rho ROT factor is determined:

$$\Delta\rho_{ROT} = (ds)[\ln\{{}^{(CR+\Delta CR)}/_{(CR-\Delta CR)}\}]$$

where ds is detector sensitivity.

Finally, the rotational bulk density is determined:

$$\rho_{b\ ROT} = D\rho_L + E\rho_S + F\Delta\rho_{ROT}$$

where D, E, and F are experimentally determined coefficients;

$\rho_L$=long spacing density obtained as illustrated in FIG. 9; and $\rho_S$=short spacing density obtained as illustrated in FIG. 9.

As indicated in FIGS. 10C, 10D-1 and 10OD-2 also, the $\rho_{b\ ROT}$ factor and ΔCR factor are also determined in the same way for each quadrant, but of course, rather than using all of the samples of FIG. 10C, only those samples collected in the $Q_{TOP}$ quadrant, for example, are used in the determination for the $Q_{TOP}$ quadrant. As indicated in FIGS. 10A-1 and 10A-2, the $\Delta\rho_{ROT}$ factor and $\rho_{b\ ROT}$ value are determined, according to the invention, for the entire borehole and for each quadrant.

Figure 11A:
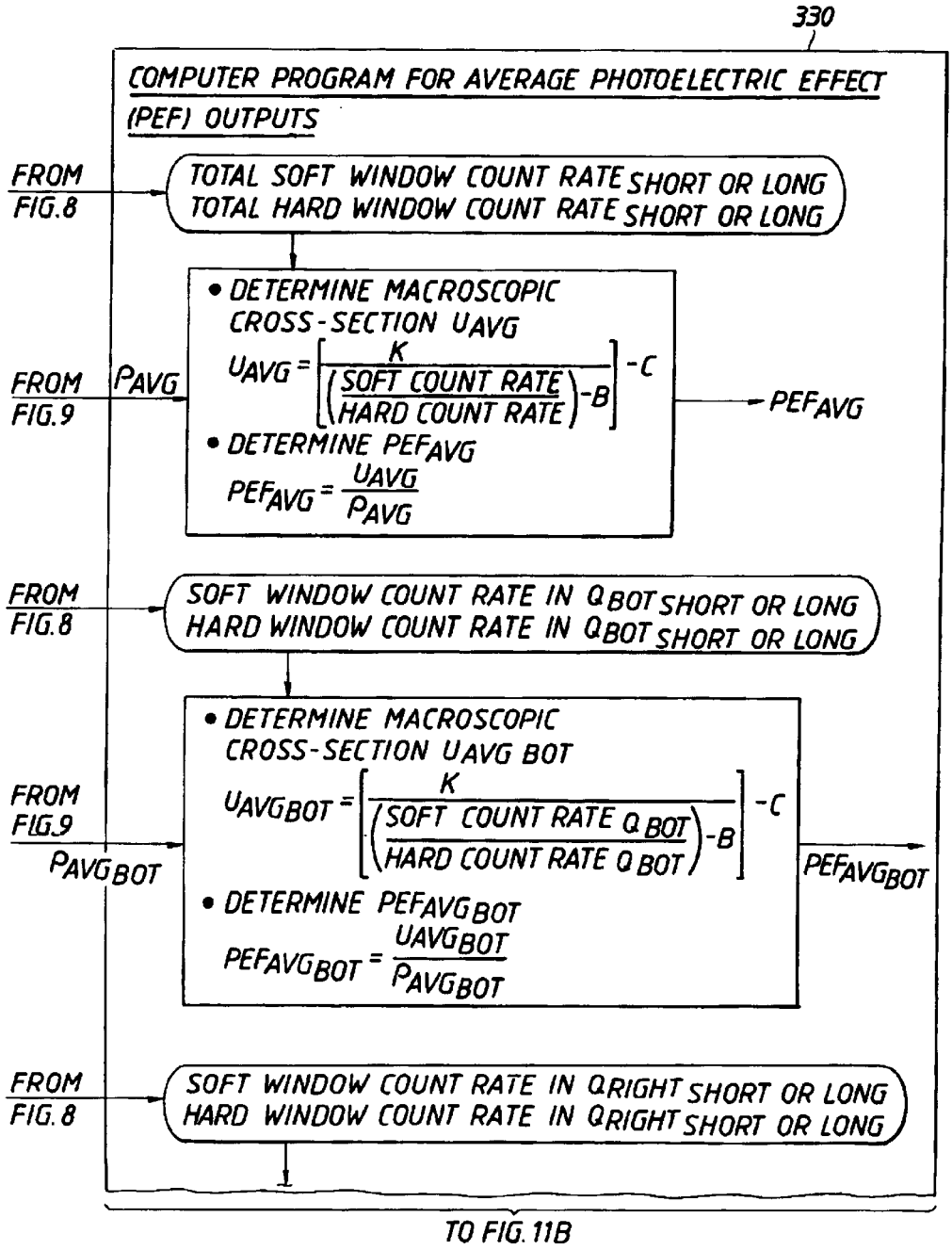
FIGS. 11A and 11B illustrate a computer program in the LWD computer for determining the average photoelectric effect (PEF) for the entire borehole and for each of the quadrants.
Figure 11B:
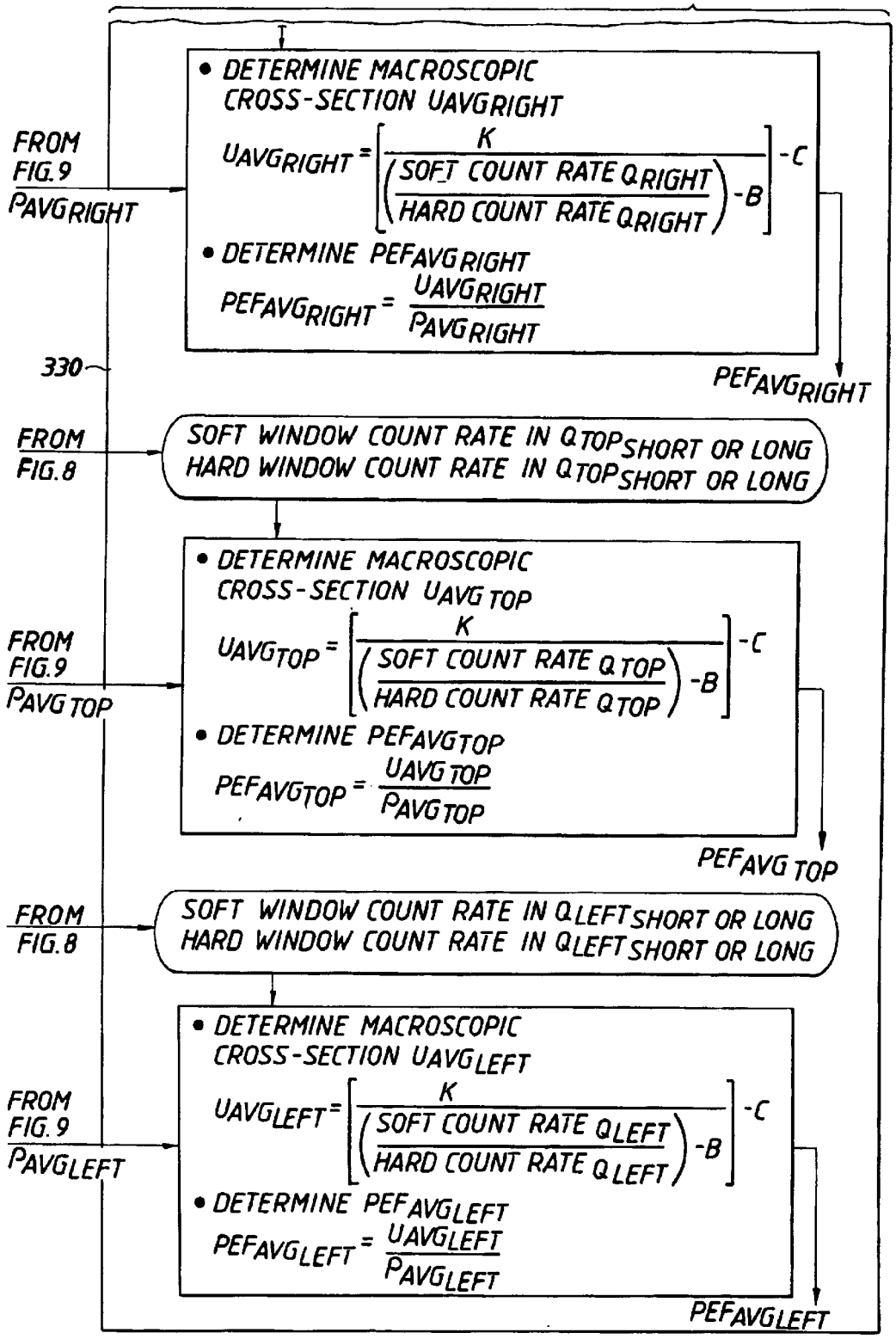

Determination for Average and Rotational Photoelectric Effect (PEF) Outputs for Entire Borehole and as a Function of Quadrants:

Determination of PEF AVG:

FIGS. 11A and 11B illustrate computer program 330 which determines photoelectric effect parameters as, alternatively, a function of short spaced detector soft window count rate and short spaced detector hard window count rate or long spaced detector soft window count rate and long spaced detector hard window count rate. Using the short spaced or long spaced detector count rate for the entire borehole and the $\rho_{avg}$ as an input from computer program 320, the factor $$PEF_{avg} = U_{avg}/\rho_{avg}$$

is determined, where the macroscopic cross-section, $$U_{avg} = [K/\{({}^{SOFT\ COUNT\ RATE}/_{HARD\ COUNT\ RATE}) - B\}]^{-C}$$

The terms K, B and C are experimentally determined constants.

In a similar manner, as shown in FIGS. 11A and 11B, the $U_{AVG\ BOT}$, $U_{AVG\ RIGHT}$, $U_{AVG\ TOP}$, and $U_{AVG\ LEFT}$ are determined from short spaced or long spaced detector soft and hard window count rates while the sensor is in the bottom, right, top and left quadrants, respectively.

Figure 12A:
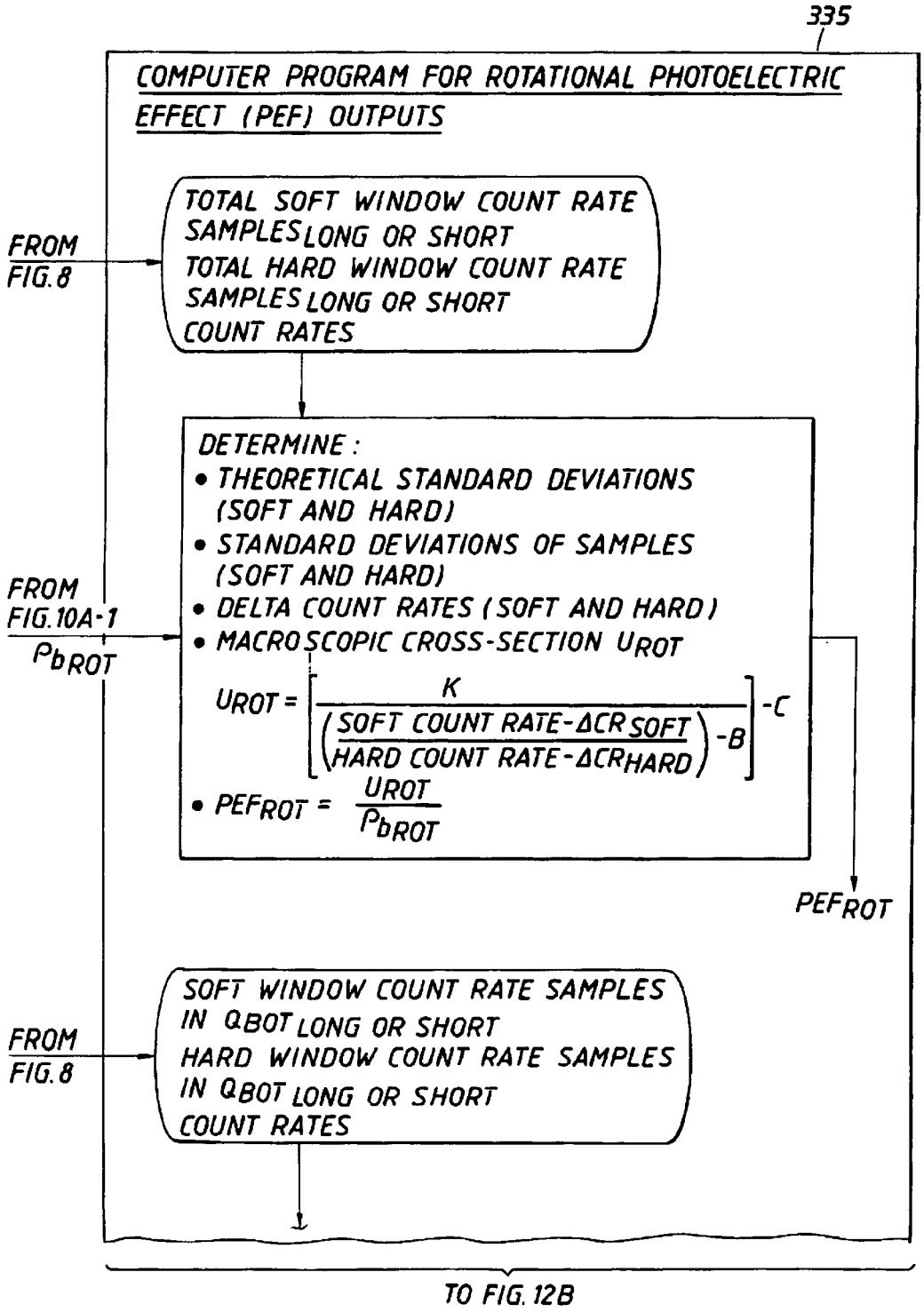
FIGS. 12A–C illustrate a computer program in the LWD computer for determining rotational photoelectric effect (PEF) outputs for the entire borehole and for each quadrant.
Figure 12B:
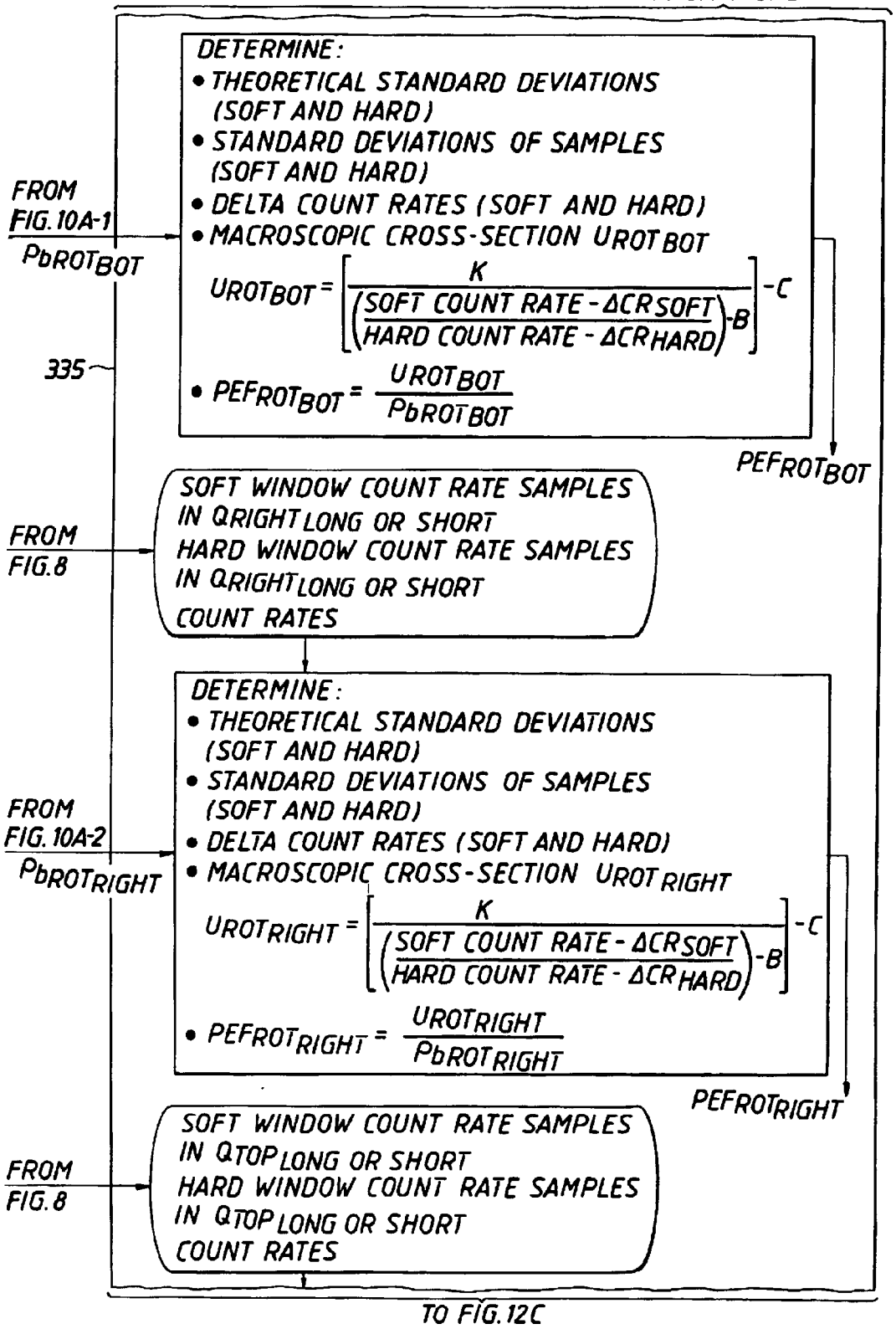
Figure 12C:
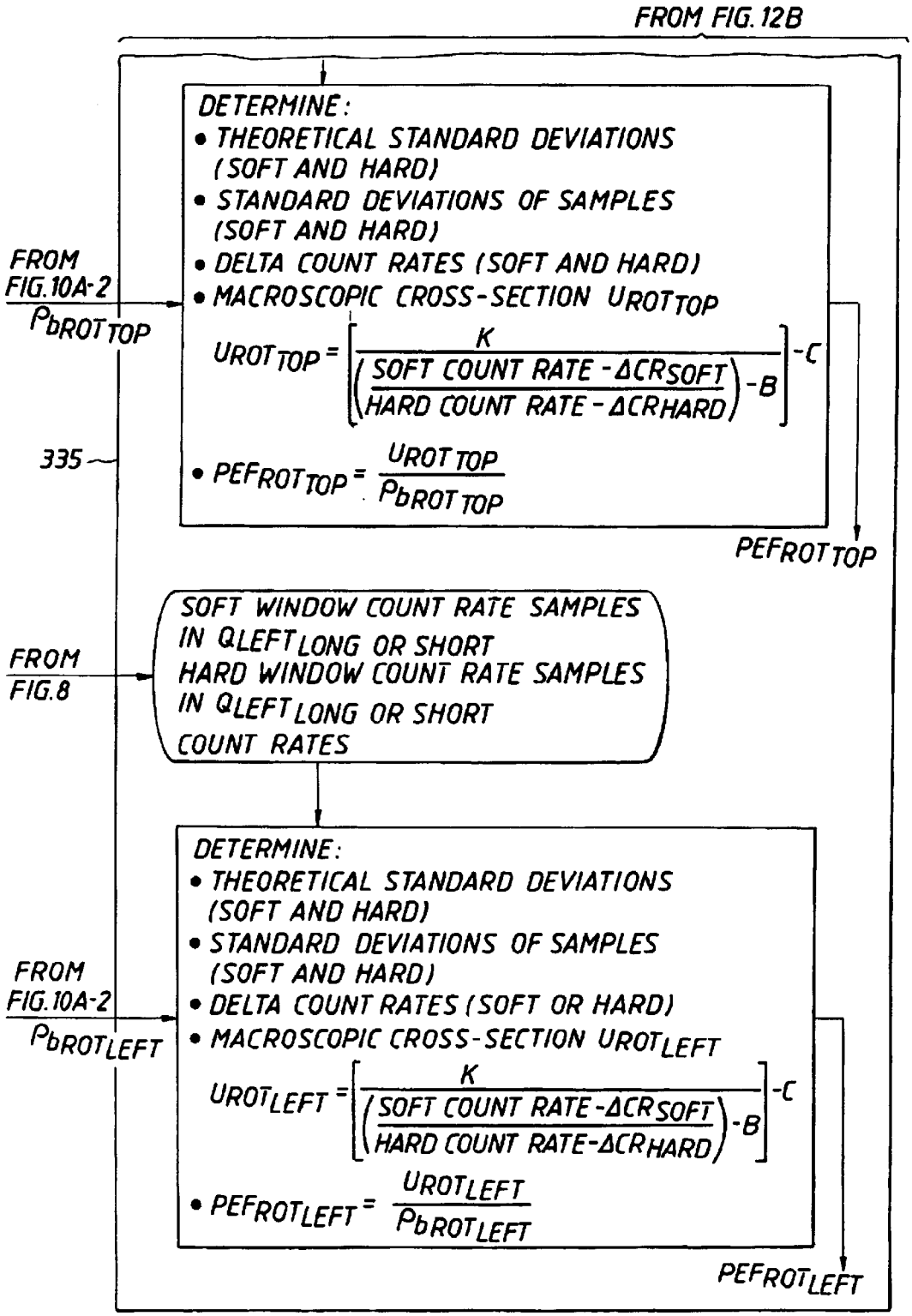

Determination of Rotational PEF:

FIGS. 12A–C illustrate computer program 335 in downhole computer 301 (from FIG. 3A). The total soft and hard window count rate distributions from the long spaced or, alternatively, the short spaced gamma ray detector, and the corresponding count rates are accumulated.

In a manner similar to that described above with regard to the calculation of rotational density, a $\Delta CR_{SOFT}$ factor is determined from the soft count rate distribution, $$\Delta CR_{SOFT} = A(\sigma^2_{meas} - \sigma^2_{theor})^{0.5}$$

where A is a constant which is a function of the data sampling rate. Similarly, a $\Delta CR_{HARD}$ is determined from the hard count rate distribution. Next, macroscopic cross-section, $U_{ROT}$, and $PEF_{ROT}$ factors are determined:

$$U_{ROT} = [K/\{({}^{(SOFT\ COUNT\ RATE - \Delta CRSOFT)}/_{(HARD\ COUNT\ RATE - \Delta CRHARD)}) - B\}]^{-C}$$

where K, B and C are experimentally determined constants, and $$PEF_{ROT} = U_{ROT}/\rho_{b\ ROT}$$

where $\rho_{b\ ROT}$ is determined in computer program 328 as illustrated in FIGS. 10A-1, 10A-2, 10D-1 and 10D-2.

Rotational Photo Electric Factor is borehole Photoelectric factor corrected for borehole irregularity effects on the PEF measurement.

In a similar manner, the $PEF_{ROT}$ factor for each quadrant is also determined, as illustrated in FIGS. 12A–C.

The PEF is an indicator of the type of rock of the formation and a useful measurement in determining mud properties. Accordingly, $PEF_{AVG}$ is an indicator of the type of rock and properties of the mud, on the average, for the entire borehole. The $PEF_{AVG}$ per quadrant is an indicator of the type of rock or properties of the mud for each quadrant and hence heterogeneity of the formation. $PEF_{ROT}$ signals, as determined by program 335 (FIGS. 12A–C) provide further information as to the properties of the mud and cuttings and as to the kind of rocks of the formation.

Figure 12E:
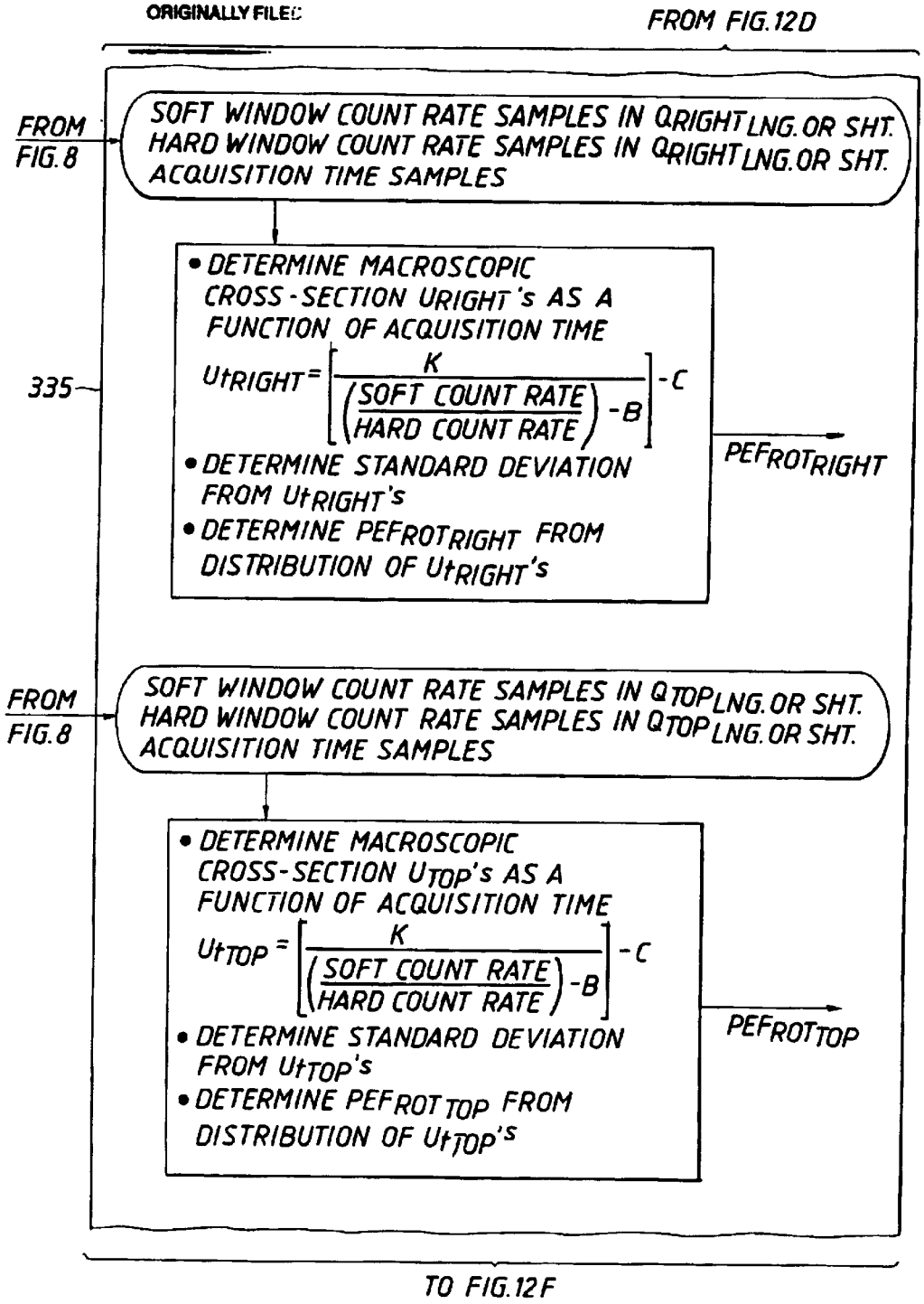
Figure 12F:
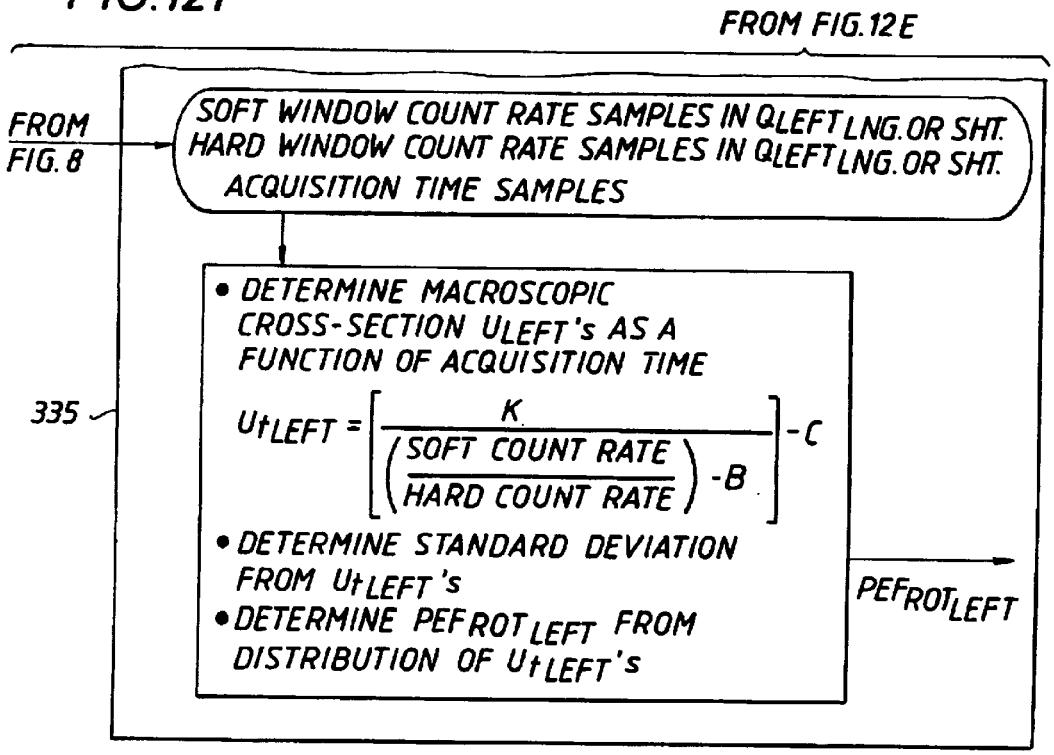

An alternative methodology for determining rotational PEF is illustrated in FIGS. 12D–F. The total soft count rate and total hard count rate from the long spaced or, alternatively, the short spaced gamma ray detector are accumulated for a plurality of acquisition time samples. Next, for each such acquisition time sample, a macroscopic cross section factor $U_t$ is determined as a function of acquisition time t:

$$U_t = [K/\{({}^{SOFT\ COUNT\ RATE}/_{HARD\ COUNT\ RATE}) - B\}]^{-C}$$

where K, B and C are experimentally determined constants.

Next, the standard deviation is determined from the distribution of $U_t$ factors. Finally, a rotational value of photoelectric effect, $PEF_{ROT}$, is determined from the distribution of $U_t$'s. Such rotational value is determined in a manner similar to that illustrated in FIGS. 10A-1, 10A-2, 10D-1 and 10D-2 for the determination of $\rho_{b\ ROT}$ from a distribution of count rate samples as a function of count rate. The methodology then proceeds as previously described to a determination of the overall $PEF_{ROT}$ and $PEF_{ROT}$ for each quadrant.

Figure 13:
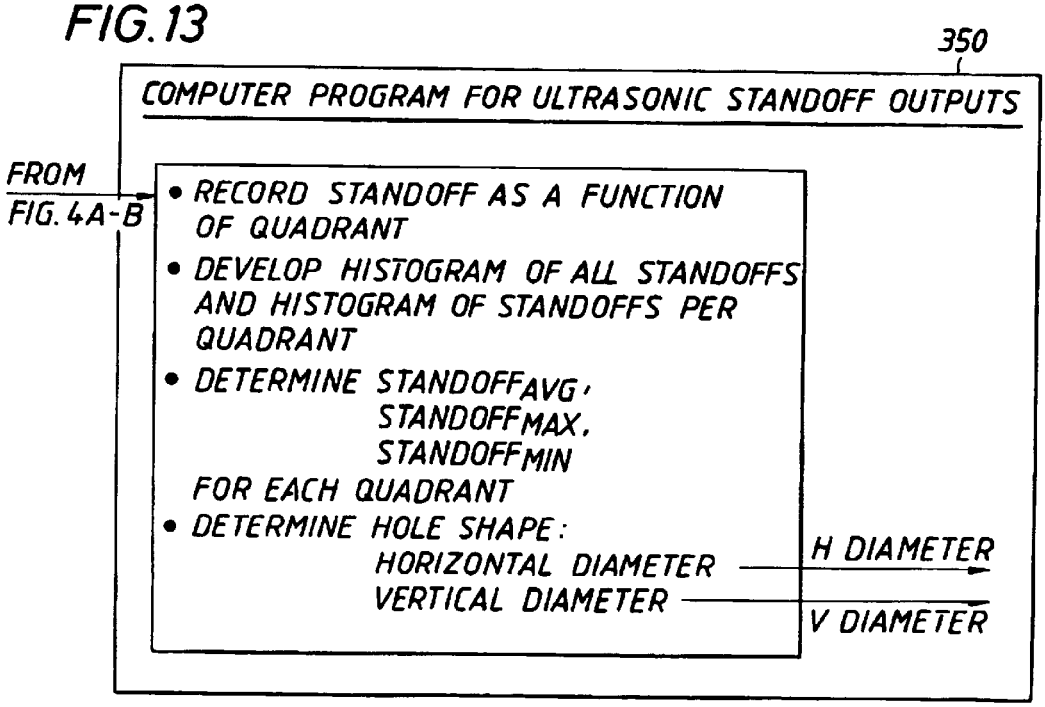
FIG. 13 illustrates a computer program in the LWD computer which accepts standoff data from the ultrasonic sensor and determines average, maximum and minimum standoff for each quadrant, and determines the horizontal and vertical diameters of the borehole so as to determine the hole shape.

Ultrasonic Standoff Determination:

As illustrated in FIG. 13, computer program 350 of downhole computer 301 (see FIG. 3A) determines borehole shape from standoff determinations based on ultrasonic signals. As mentioned above, U.S. Pat. No. 5,130,950, describes the determination of standoff. Such standoff, i.e. the distance between the ultrasonic sensor and the borehole wall, is determined as a function of quadrant and collected for each quadrant.

A distribution of standoff values are collected per quadrant for a predetermined acquisition time. From such distribution, for each quadrant, an average, maximum and minimum value of standoff is determined. From such values, a "vertical" diameter of the borehole, using the average standoff of the bottom quadrant plus the tool diameter plus the average standoff of the top quadrant is determined. The "horizontal" diameter is determined in a similar manner from the left and right quadrants and the tool diameter.

Determination of Maximum or Minimum Rotational Density:

As described above, rotational density is determined around the entire borehole and for each of the quadrants to compensate for borehole effects when the spine and ribs technique may not be effective. Also described above is a determination of whether apparent mud density in the borehole, that is the measured density including photoelectric effect, is greater than or less than apparent formation density by incorporating information from the ultrasonic measurement of standoff per quadrant as described above with respect to FIG. 13. If the average gamma ray counts in a quadrant with standoff (e.g., top quadrant) are higher than the average gamma ray counts in a quadrant with no standoff (e.g., bottom quadrant), then apparent formation density is determined to be higher than apparent mud density. Therefore, a maximum rotational density is determined, and it possible to determine the density of the formation and the mud.

Alternatively, if the average gamma ray counts in a quadrant with standoff (e.g. top quadrant) are lower than the average gamma ray counts in a quadrant with no standoff (e.g. bottom quadrant), then apparent formation density is determined to be lower than apparent mud density. Therefore, a minimum rotational density is determined, and it possible to determine the density of the formation and the mud.

Figure 14A:
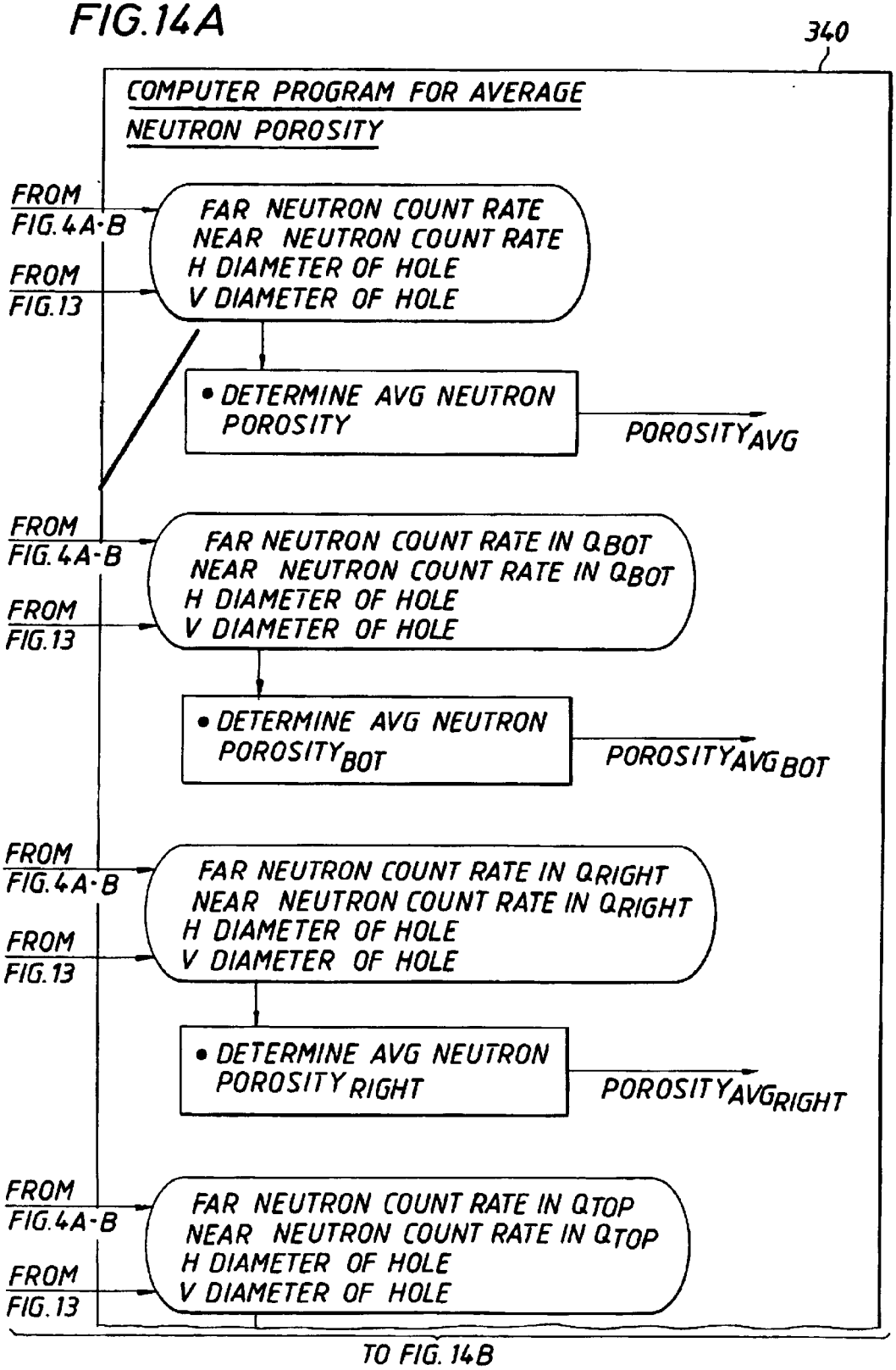
FIGS. 14A and 14B illustrate a computer program in the LWD computer for determination of average neutron porosity, as corrected of standoff, for the entire borehole and for each quadrant.
Figure 14B:
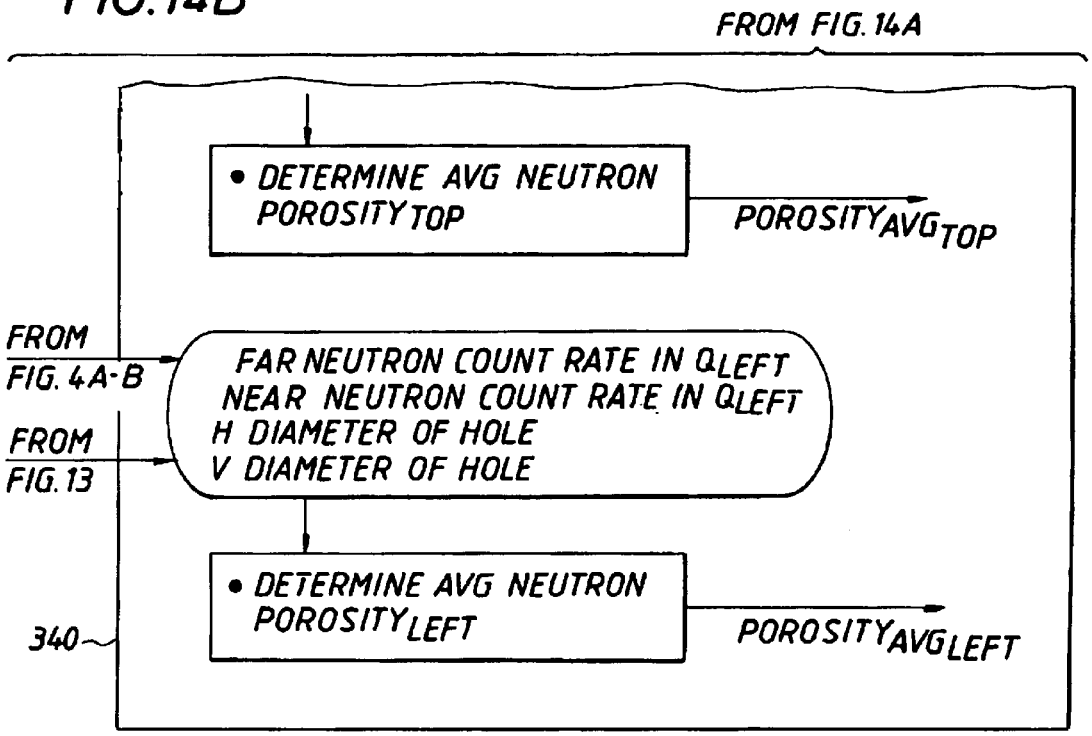

Determination of Average Neutron Porosity:

FIGS. 14A and 14B illustrate a computer program 340 of downhole computer 301 which accepts near and far detector neutron count rates from LWD tool 100 (see FIG. 2). It also accepts horizontal and vertical hole diameter digital signals from computer program 350 (from FIG. 13 and discussed above.) Neutron count rate is affected by hole diameter. Correction curves for hole size for neutron count rates are published in the technical literature. Accordingly, measured near and far neutron count rates are corrected, in this aspect of the invention, by using correction curves or tables for hole size as determined by the ultrasonic sensor and associated computer program 350 as described above. Average porosity determination from program 340 using all borehole counts and compensated for offset of the tool from the borehole as a function of quadrants is made in a conventional manner.

In a similar way a porosity signal is determined for each of the individual quadrants from far and near neutron detector count rates per quadrant and from such hole shape data As illustrated in FIGS. 14A and 14B, a method and a programmed computer is disclosed for determining neutron porosity of mud within an inclined borehole and an earth formation surrounding an inclined borehole in which a logging while drilling tool 100 is operating (see FIGS. 1 and 2). The tool 100 includes a source of neutrons 104 and near spaced and far spaced detectors 101, 102 of neutrons which result from interaction of neutrons from the source of neutrons 104 with the mud and the formation. An ultrasonic sensor or transceiver 112 is also provided with tool 100.

The method includes first determining a bottom contact point of the tool 100 which contacts the inclined borehole while the tool 100 is rotating in the borehole (see FIG. 4A). Next, a bottom angular distance segment, called SEGMENT BOTTOM of the borehole is defined which includes the bottom contact point (see FIGS. 4A and 6A for one way of determining a bottom quadrant $Q_{BOT}(t)$.

Next, as illustrated by FIGS. 14A and 14B, for a predetermined length of time, a far neutron count of the far spaced neutron detector 102 and a near count rate of the near spaced neutron detector 101 is recorded for the bottom angular distance segment.

With the ultrasonic sensor 112, the average BOTTOM STANDOFF is made from ultrasonic measurements while the tool is in the bottom angular distance segment $Q_{BOT}(t)$. Next, an average neutron porosity is determined as a function of the near neutron count rate and the far neutron count rate measured in the bottom segment and corrected by the BOTTOM STANDOFF determined above.

The procedure described above is repeated respectively for the angular distance segments called $Q_{RIGHT}$, $Q_{TOP}$, and $Q_{LEFT}$. The total borehole average neutron porosity is also determined as a function of near and far neutron count rates detected in $Q_{BOT}$, $Q_{RIGHT}$, $Q_{TOP}$, and $Q_{LEFT}$. Each of such count rates is separated into formation and mud measurements by standoff measurements of the respective segments: average BOTTOM STANDOFF, average RIGHT STANDOFF, average TOP STANDOFF and average LEFT STANDOFF.

Figure 15A:
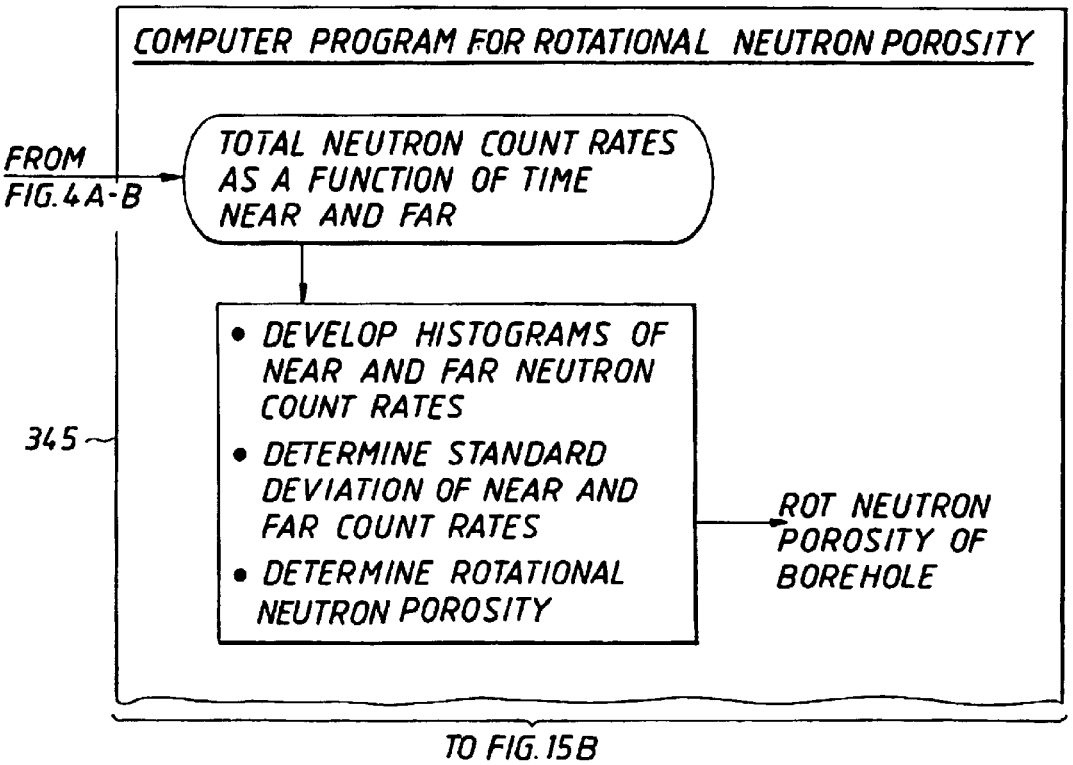
FIGS. 15A–C illustrate a computer program in the LWD computer for determination of rotational neutron porosity for the entire borehole and for each quadrant.

As illustrated in FIG. 15A, a method and computer program is provided for determining rotational neutron porosity. First, a histogram of near and far neutron count rates for the entire borehole is produced. Next, a signal (e.g., produced by program 345) representative of the standard deviation of the histogram of near count rates and a signal representative of the standard deviation of the far count rates is determined. For the entire borehole, a signal is determined which is proportional to the difference in the variance of all near count rates from the near spaced detector and a signal proportional to the expected variance of the count rates for a circular borehole is determined. From such signals, a porosity rotation correction factor, called $\Delta P_{ROT}$, is produced. Such porosity rotation correction factor is representative of a porosity measurement correction needed to correct a porosity measurement of the borehole for borehole irregularity about the entire borehole.

Rotational porosity, $P_{ROT}$, is determined as a function of $\Delta P_{ROT}$, and near and far spaced neutron detector signals which are representative of porosity. Such signals are called $P_N$ and $P_F$ respectively. The rotational porosity $P_{ROT}$ may be determined as:

$$P_{ROT}=MP_N+NP_F+Q\Delta P_{ROT}$$

in a manner similar to the way rotational bulk density is determined as described above. The constants M, N and Q are experimentally determined coefficients.

Figure 15B:
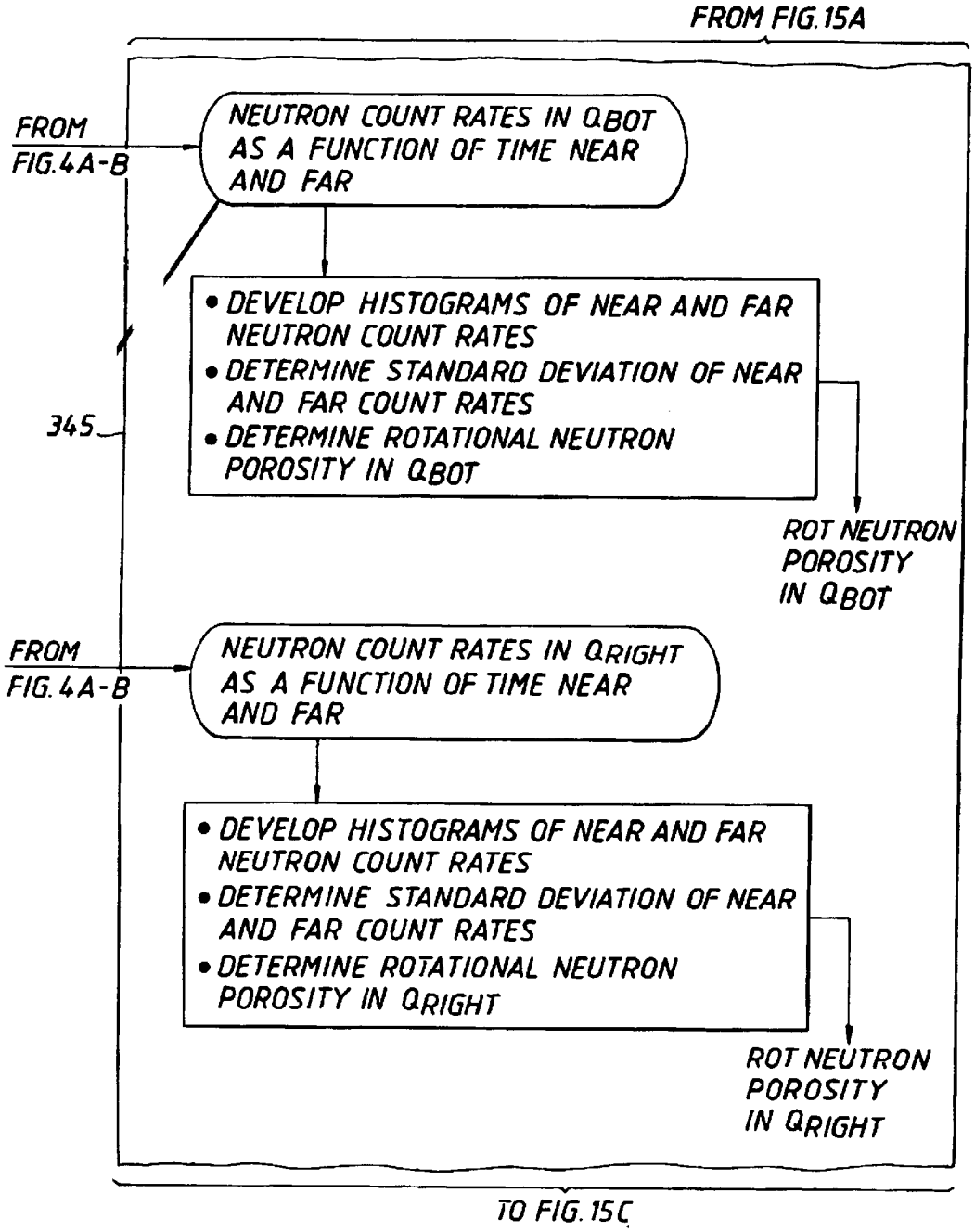
Figure 15C:
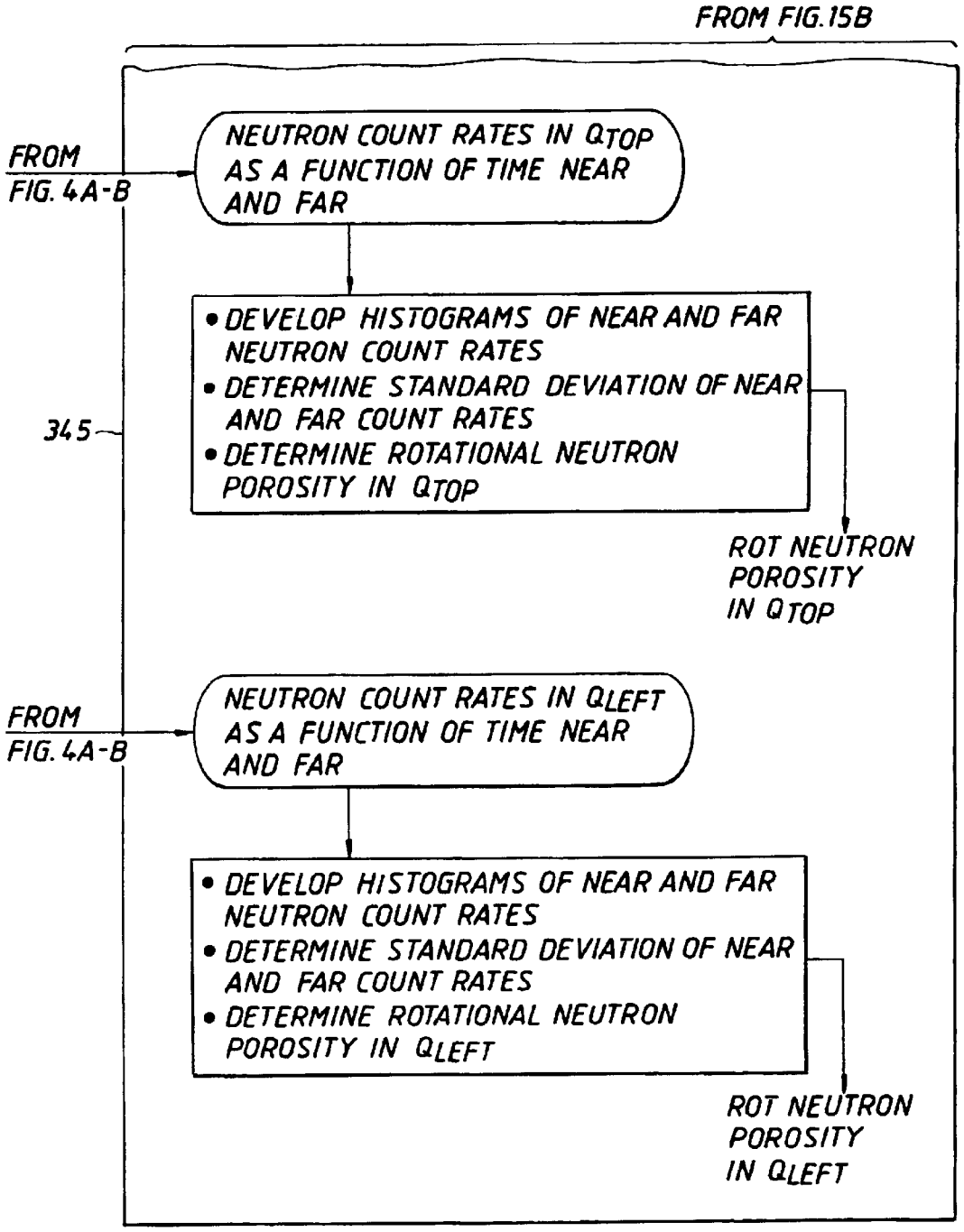

Determination of Rotational Neutron Porosity:

FIGS. 15A–C illustrate computer program 345 of downhole computer 301 (see FIG. 3A) which accepts total near and far neutron count rates. Histograms, that is distributions, are produced from all such count rates during the acquisition time. The standard deviation of each distribution is determined. Such standard deviations are used to determine rotational neutron porosity for the entire borehole and for each quadrant in a manner similar to that described in FIGS. 10D-1 and 10D-2 for the determination of rotational bulk density. Rotational neutron porosity is neutron porosity of mud within a borehole and an earth formation surrounding a borehole corrected for standoff measured as a function of angular distance around the borehole.

Determination of Formation Heterogeneity:

FIG. 4B illustrates a borehole which is surrounded not by a homogeneous formation, but by two different rock formations. The methods of this invention are ideally suited for accessing the degree of formation heterogeneity which exists about the borehole.

Using density measurements, or porosity measurements as disclosed herein, such signals as associated in each particular one of the plurality of angular distance segments defined by the apparatus of FIG. 1 and FIGS. 3A and 3B, and according to computer program 310, a signal characteristic of the formations surrounding the borehole and the mud and cuttings within the borehole, such as density, PEF, or porosity, is derived for each of the angular distance segments. Formation and/or mud heterogeneity is assessed by comparing one signal characteristic of the mud and/or formation from one angular distance segment to another. Such comparison may take the form of a simple differencing of such characteristic from one segment to another, or it may take the form of determining a statistical parameter such as standard deviation or variance of a characteristic, such as porosity or density, and comparing (e.g. by differencing) such statistical parameter of one segment with another.

Figure 16B:
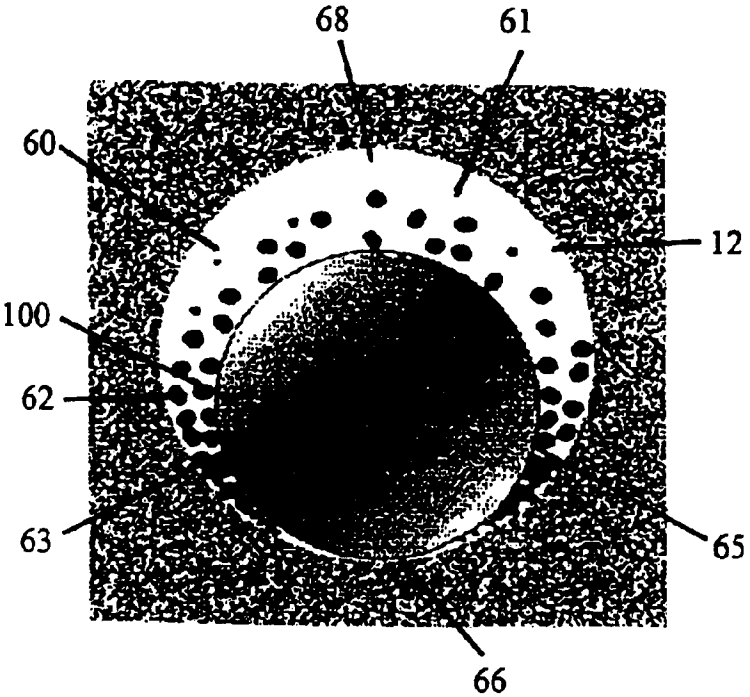
FIGS. 16A–B illustrate a sectional view of the LWD tool in an inclined borehole with mud and cuttings.
Figure 16A:
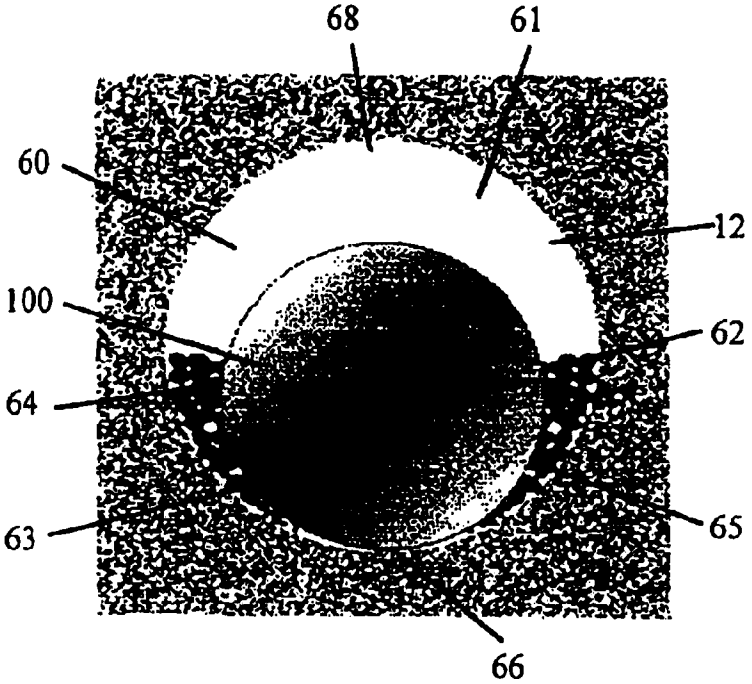

Determination of Mud and Cuttings Properties:

FIG. 16A represents one illustration which can be identified using an embodiment of the invention, where the tool 100 is in a deviated borehole 12, on the bottom side 66 of the borehole 12. Typically, the tool 100 will lay on the bottom side 66 due to gravity (in a deviated borehole). The annulus 60 is the crescent-shaped area of the borehole 12 that is not occupied by the tool 100. The annulus 60 of the borehole 12 is occupied by the mud 61 and cutting pieces 62. In this illustration, the cutting pieces 62 have aggregated to form a cuttings bed 64. This cuttings bed 64 formation typically occurs due to gravity: the cutting pieces 62 have a higher density than the mud 61, and so the cutting pieces 62 fall to the bottom 66 of the borehole 12 and form a cuttings bed 64. There are methods that are known in the art to prevent cuttings bed 64 formation that include increasing the RPM of the drill string 10, using a higher density mud 61, increasing the mud 61 flow through the drill string 10.

FIG. 16B represents another illustration where the tool 100 is in a deviated borehole 12, on the bottom side 66 of the borehole 12. Typically, the tool 100 will lay on the bottom side 66 due to gravity (in a deviated borehole). The annulus 60 is the crescent-shaped area of the borehole 12 that is not occupied by the tool 100. The annulus 60 of the borehole 12 is occupied by the mud 61 and cutting pieces 62. In this illustration, the cutting pieces 62 have remained mixed in the mud 61.

The tool 100 (see FIG. 2) may be used to detect cuttings bed build-up as they accumulate near the tool's sensors. When drilling a highly deviated section of a well, the tool 100 (see FIG. 1) typically lays on the low side of the borehole 12, with a distribution of cuttings and mud about the tool's circumference. The tool 100 can provide azimuthal density distributions around the borehole 12 as the drillstring 6 rotates, as explained above.

Assuming a 70% packing of the cuttings, the bulk density of a cuttings bed would be equal to:

$$\rho_{CB}=(0.7\rho_F)+(0.3\rho_M)$$

where $\rho_{CB}$ equals the density of the cuttings bed that has formed, $\rho_f$ equals the density of the cuttings from the formation, and $\rho_M$ equals the density of the mud.

One embodiment of the invention provides a method of determining if there has been a cutting bed 64 formed (as seen in FIG. 16A) or if the cutting pieces 62 have remained mixed in the mud 61 (as seen in FIG. 16B). In both scenarios, the top quadrant 68 is substantially comprised of a mixture of mud 61 and cutting pieces 62, and will have a density substantially equal to $\rho_M$. The bottom half of the left quadrant 63 and the bottom half of the right quadrant 65 have a cutting bed 64 in the first scenario (as seen in FIG. 16A) and will have a density of $\rho_{CB}$. The bottom half of the left quadrant 63 and the bottom half of the right quadrant 65 will be a mixture of mud 61 and cutting pieces 62 in the second scenario (as seen in FIG. 16B) and will have a density of $\rho_M$. By comparing the density value measured in the top quadrant 68 to the density value measured in the bottom half of the left quadrant 63 and the bottom half of the right quadrant 65, it can be determined if a cuttings bed 64 has formed.

Assuming a packing ratio of 70%, the difference between $\rho_{CB}$ and $\rho_M$ is:

$$\rho_{CB}-\rho_M=0.7(\rho_F-\rho_M)$$

Typically, the value of the difference between $\rho_{CB}$ and $\rho_M$ is on the order of about 1 g/cm, which is within the resolution range of the tools and algorithms available.

In another embodiment, the tool 100 (see FIG. 2) may be used to determine the packing ratio of the cutting pieces 62 in the mud 61, and to determine the distribution of the cutting pieces 62 about the tool 100 in the annulus 60 of the borehole 12. The density measurements that are made as the tool 100 rotates can be compared with each other and with the known density of the mud 61 and/or the formation. This comparison will lead to a determination of the packing ratio of the cutting pieces 62 in the mud.

In another embodiment, the tool 100 (see FIG. 2) may be used to detect cuttings bed build-up as they accumulate near the tool's sensors by measuring the photo-electric effect (PEF) of the mud 61, cutting pieces 62, and cuttings bed 64. The tool 100 can provide PEF distributions around the borehole 12 as the drillstring 6 rotates, as explained above.

One embodiment of the invention provides a method of determining if there has been a cutting bed 64 formed (as seen in FIG. 16A) or if the cutting pieces 62 have remained mixed in the mud 61 (as seen in FIG. 16B). In both scenarios, the top quadrant is substantially comprised of a mixture of mud 61 and cutting pieces 62, and will return a PEF of $PEF_M$. The bottom half of the left quadrant 63 and the bottom half of the right quadrant 65 will be a cutting bed 64 in the first scenario (as seen in FIG. 16A) and will return a PEF of $PEF_{CB}$. The bottom half of the left quadrant 63 and the bottom half of the right quadrant 65 will be a mixture of mud 61 and cutting pieces 62 in the second scenario (as seen in FIG. 16B) and will return a density of $PEF_M$. By comparing the density value returned from the top quadrant to the density value returned from the bottom half of the left quadrant 63 and the bottom half of the right quadrant 65, it can be determined if a cuttings bed 64 has formed.

Assuming a packing ratio of 70%, the difference between $PEF_{CB}$ and $PEF_M$ is:

$$PEF_{CB}-PEF_M=70\%\times(PEF_F-PEF_M)$$

Typically, the value of the difference between $PEF_{CB}$ and $PEF_M$ is on the order of about 1, which is within the resolution range of the tools and algorithms available. The value of the difference between $PEF_{CB}$ and $PEF_M$ can be much larger than 1 when the mud contains barite.

In another embodiment, the tool 100 (see FIG. 2) may be used to determine the packing ratio of the cutting pieces 62 in the mud 61, and to determine the distribution of the cutting pieces 62 about the tool 100 in the annulus 60 of the borehole 12. The PEF measurements that are returned as the tool 100 rotates can be compared with each other and with the known PEF measurements of the mud. This comparison will lead to a determination of the packing ratio of the cutting pieces 62 in the mud.

In one embodiment, the mud measurement may be made when the tool rotates such that the tool acquires data in the "up" quadrant. Due to their proximity to the source, the depth of investigation of the near detectors is on the order of 3 inches. This distance is less than the approximately 4 inch gap between the tool surface and the top of the borehole. The body of the tool behind the near bank also restricts the sensitivity of these detectors to the side of the tool on which they reside. The combination of these effects yields a sufficiently shallow and focused response to enable a mud measurement. While the tool is in the up quadrant, the near detectors respond mainly to the mud. In particular, the count rate of the near epithermal detector in the up quadrant is sensitive to the relative concentration of hydrogen in the mud (the mud hydrogen index), and the ratio of the count rate in this detector to the total count rate in the near thermal detectors corresponds mainly to the salinity of the mud.

In another embodiment, while the tool 100 is in the down quadrant, most response comes from the formation. In particular, the count rate of the near epithermal detector in the down quadrant is sensitive to the relative concentration of hydrogen in the formation (the formation hydrogen index), and the ratio of the count rate in this detector to the total count rate in the near thermal detectors corresponds mainly to the salinity of the formation. By recording sector-based count rates, the separate mud- and formation-derived responses are preserved. In another embodiment, these measurements may complement the standard neutron porosity measurement derived from the ratio of the total near thermal detector count rate to the total far detector count rate in the down quadrant. In contrast to the near detectors, the far detector depth of investigation is too deep to respond mainly to borehole or formation effects but is sensitive to both. Taking the near/far ratio reduces but does not eliminate this borehole dependence.

Detecting a Kick in the Borehole:

In the course of drilling a well, a formation with higher pore-pressure than mud pressure at the same depth can be encountered. In this pressure imbalance situation, formation pore fluid can leak into the borehole 12 and result in a kick. Depending on the type of pore fluid (for example water, oil, or gas), the size of the kick, and the time it takes to detect the kick, the consequences of the kick may be different. Consequences of a kick may include underground blowouts, loss of human life, environmental disasters, lost rigs, lost wells, and cost millions of dollars. Time to detect the kick has a direct bearing on the size of the kick; the sooner the kick is detected the better the well can be controlled.

In one embodiment, the tool 100 can be used to detect a kick in a vertical well. In another embodiment, the tool 100 can be used to detect a kick in a horizontal well.

Figure 17B:
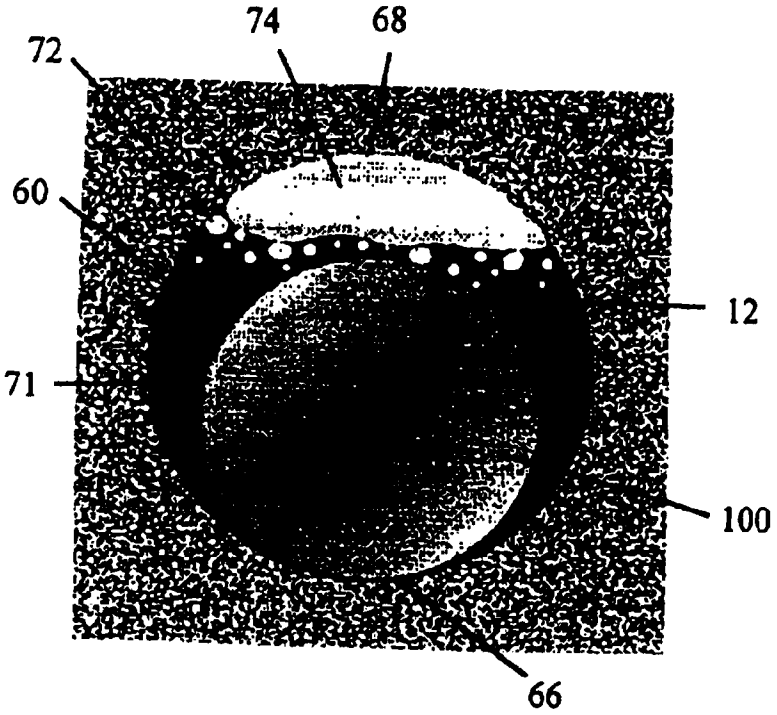
FIG. 17B illustrates a sectional view of the LWD tool in an inclined borehole with mud, a fluid pocket, and fluid bubbles.

FIG. 17B represents one embodiment where the tool 100 is in a deviated borehole 12, on the bottom side 66 of the borehole 12. Typically, the tool 100 will lay on the bottom side 66 due to gravity (in a deviated borehole). The annulus 60 is the crescent-shaped area of the borehole 12 that is not occupied by the tool 100. The annulus 60 of the borehole 12 is occupied by the mud mixture 71 (which is a mixture of the mud 61 and cutting pieces 62 both seen in FIG. 16B). In this embodiment, fluid bubbles 72 have aggregated to form a fluid pocket 74. This fluid pocket 74 formation typically occurs due to gravity: the fluid bubbles 72 have a lower density than the mud 61, and so the fluid bubbles 72 aggregate at the top 68 of the borehole 12 and form a fluid pocket 74. (Examples of materials that may form the fluid bubbles 72 and/or fluid pocket 74 may include gas, oil, and/or water). There are methods that are known in the art to prevent a kick that forms a fluid pocket 74 that include increasing the downhole mud pressure, using a higher density mud 61, and increasing the mud 61 flow through the drill string 10.

Figure 17A:
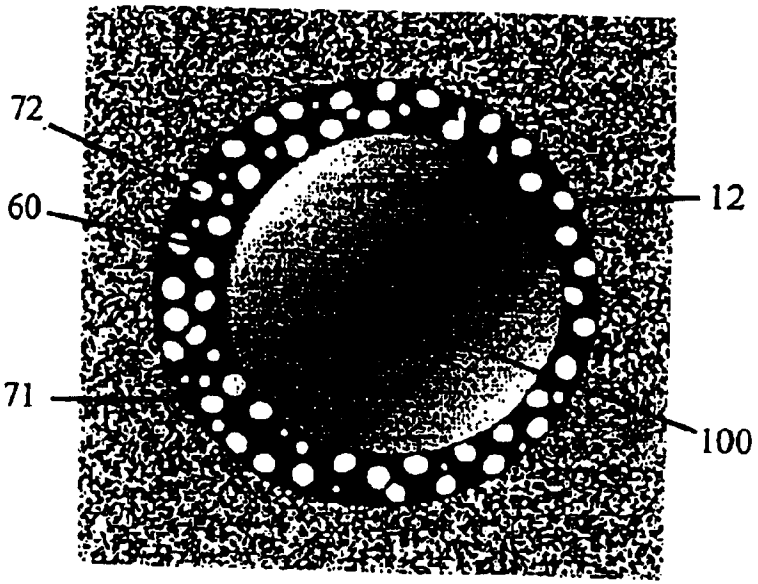
FIG. 17A illustrates a sectional view of the LWD tool in a vertical borehole with mud and fluid bubbles.

FIG. 17A represents one embodiment where the tool 100 is in a vertical borehole 12 or stabilized in the middle of a borehole 12. The annulus 60 is the donut-shaped area of the borehole 12 that is not occupied by the tool 100. The annulus 60 of the borehole 12 is occupied by the mud mixture 71 (which is a mixture of the mud 61 and cutting pieces 62 both seen in FIG. 16B). In this embodiment, the fluid bubbles 72 are dispersed throughout the mud mixture 71. (Examples of materials that may form the fluid bubbles 72 may include gas, oil, and/or water). There are methods that are known in the art to prevent a kick that forms fluid bubbles 72 that include increasing the downhole mud pressure, using a higher density mud 61, and increasing the mud 61 flow through the drill string 10.

One embodiment of the invention provides a method of determining if there has been a kick where fluid bubbles 72 and/or a fluid pocket 74 have formed in the mud mixture 71. In both scenarios, the top quadrant is substantially comprised of the mud mixture 71 and fluid bubbles 72 and/or a fluid pocket 74, and will have a density of $\rho_{FP}$. In a vertical borehole 12, as seen in FIG. 17A, the $\rho_{FP}$ value will be lower than the normal $\rho_M$ value that is normally measured when there has not been a kick, and/or a known $\rho_M$ value for the mud mixture. Similarly, in a deviated borehole 12, as seen in FIG. 17B, the $\rho_{FP}$ value will be lower than the normal $\rho_M$ value that is normally returned when there has not been a kick, and/or a known $\rho_M$ value for the mud mixture. In addition, for a deviated borehole 12, the bottom half of the left quadrant 63 and the bottom half of the right quadrant 65 will be a mud mixture 71 (as seen in FIG. 17B) and will return a density of $\rho_M$. By comparing the density value measured in the top quadrant to the density value measured in the bottom half of the left quadrant 63 and/or the bottom half of the right quadrant 65 and/or a known $\rho_M$ value for the mud mixture, it can be determined if a kick has occurred where fluid bubbles 72 and/or a fluid pocket 74 have formed.

Assuming a fluid ratio of 70% (a mixture of about 70% fluid and about 30% mud), the difference between $\rho_{FP}$ and $\rho_M$ is:

$$\rho_M-\rho_{FP}=0.7(\rho_M-\rho_{FL})$$

where $\rho_M$ is the density of the mud, $\rho_{FP}$ is the density of the fluid and mud mixture, and $\rho_{FL}$ is the density of the fluid.

Typically, the value of the difference between $\rho_M$ and $\rho_{FP}$ is on the order of about 1 g/cc, which is within the resolution range of the tools and algorithms available.

In another embodiment, the tool 100 (see FIG. 2) may be used to detect a kick and fluid bubbles 72 and/or a fluid pocket 74 as they accumulate near the tool's sensors by measuring the photo-electric effect (PEF) of the mud 61, fluid bubbles 72 and/or a fluid pocket 74. The tool 100 can provide PEF distributions around the borehole 12 as the drillstring 6 rotates, as explained above. It is expected that the PEF values will decrease as fluid bubbles 72 and/or a fluid pocket 74 form due to a kick.

In another embodiment, the tool 100 (see FIG. 2) may be used to detect a kick and fluid bubbles 72 and/or a fluid pocket 74 as they accumulate near the tool's sensors by measuring the neutron porosity of the mud 61, fluid bubbles 72 and/or a fluid pocket 74. The tool 100 could provide neutron porosity distributions around the borehole 12 as the drillstring 6 rotates, as explained above. It is expected that the neutron porosity values will decrease as fluid bubbles 72 and/or a fluid pocket 74 form due to a kick, especially if the fluid is a gas.

In another embodiment, the tool 100 (see FIG. 2) may be used to determine the ratio of the fluid bubbles 72 in the mud 61, and to determine the distribution of the fluid bubbles 72 about the tool 100 in the annulus 60 of the borehole 12. The PEF measurements that are returned as the tool 100 rotates can be compared with each other and with the known PEF measurements of the mud. This comparison will lead to a determination of the ratio of the fluid bubbles 72 in the mud 61. Similarly, the density and/or the neutron porosity measurements can be compared with each other and with known values for the mud to determine the ratio of the fluid bubbles 72 in the mud 61.

Information Storage and Processing:

In one embodiment, the density measurement is calculated from a gamma-ray source and two gamma-ray detectors (the short spacing and the long spacing) that measure gamma-ray counts in different energy windows. Typically, each of these window counts has a characteristic response function ($W_i$) that is predominantly a function of the formation bulk density ($\rho_F$), the mud bulk density ($\rho_M$), the formation photoelectric factor ($PEF_F$), the mud photoelectric factor ($PEF_M$), the standoff between the hole wall and the detectors ($d_{SO}$), and the intensity of the gamma ray source ($I_S$) during the time interval of the measurement.

In another embodiment, in order to normalize the various windows readings to the intensity of the gamma-ray source, the characteristic response functions of the tool ($f_i$) are introduced as follows:

$$W_i = I_S \times f_i(\rho_F, \rho_M, PEF_F, PEF_M, d_{SO})$$

In this embodiment, all of $\rho_F$, $\rho_M$, $PEF_F$, $PEF_M$, $d_{SO}$ and $I_S$ can be solved for if there are at least as many measurements ($W_i$) made as there are unknowns (in this embodiment six), provided the functions ($f_i$) are independent enough. In another embodiment, the variable ($d_{SO}$) is treated as a known parameter (from borehole and drillstring geometry), and the other five unknowns can be solved.

In one situation, when $d_{SO}$ is zero, the function $f_i$ becomes substantially insensitive to changes in $\rho_M$ and $PEF_M$. In the situation when $d_{SO}$ is zero, it is not possible to determine the mud properties.

In another situation, when $d_{SO}$ is large, the function $f_i$ becomes substantially insensitive to changes in $\rho_F$, $PEF_F$, and $d_{SO}$. In the situation when $d_{SO}$ is large, it is not possible to determine the formation properties. However, in the situation when $d_{SO}$ is large, it is possible to determine the mud properties.

In another situation, when there is little contrast between the mud properties and the formation properties, the function $f_i$ becomes substantially insensitive to changes in $d_{SO}$. In the situation when there is little contrast between the mud properties and the formation properties, it is not possible to determine the standoff ($d_{SO}$). It is possible to confuse this situation with the situation where the stand-off is very close the zero and the mud properties can be anything. The two situations expressed mathematically are:

$$f_i(\rho_F, \rho_M \approx \rho_F, PEF_F, PEF_M \approx PEF_F, \text{Any } d_{SO}) \approx f_i(\rho_F, \text{Any } \rho_M, PEF_F, \text{Any } PEF_M d_{SO} \approx 0)$$

In these and other situations, there can arise situations in which the solution to the response function ($W_i$) is not unique. In one embodiment, the situation can be addressed by treating the standoff ($d_{SO}$) as a known parameter (from borehole and drillstring geometry) and/or assuming it cannot go below a minimum value, and solving for the remaining unknowns.

In another situation, as the standoff ($d_{SO}$) between the tool and the formation increases from zero to large values, the windows counts will become less affected by the formation properties and more affected by the mud properties. In this situation, it is possible to confuse a large standoff and particular formation properties with the situation where there is a small standoff and the formation properties are confused with those of the mud. The situation expressed mathematically is:

$$f_i(\rho_F, \rho_M, PEF_F, PEF_M, PEF_F, d_{SO} >> 0) \approx f_i(\rho_M, \rho_F, PEF_M, PEF_F, d_{SO} \approx 0)$$

In these situations the solution to the response function ($W_i$) is not unique. In one embodiment, the situation can be addressed by treating the standoff ($d_{SO}$) as a known parameter (from borehole and drillstring geometry) and/or assuming it cannot go below a minimum value, and solving for the remaining unknowns. In another embodiment, the equations can be solved by using an additional gamma-ray detector, located close to the gamma-ray source, in one embodiment a back-scatter detector, to provide values for the unknowns so that the equations can be solved. A suitable example of a density tool using three detectors, is the TLD tool (three-detector lithology density tool) of the PEx tool (platform express tool), which provides different source-to-detector windows counts at three different source-to-detector spacings, which are sufficient to solve the equations for the remaining unknowns.

In one embodiment, the neutron porosity measurement is calculated from a neutron source and two neutron detectors (the short spacing and the long spacing) that measure thermal neutron counts in different energy windows. Typically, each of these window counts has a characteristic response function ($n_i$) that is predominantly a function of the formation slowing-down length ($\lambda_F$), the mud slowing-down length ($\lambda_M$), the standoff between the tool and the detectors ($d_{SO}$), and the intensity of the neutron source ($A_S$) during the time interval of the measurement.

In another embodiment, in order to normalize the various windows readings to the intensity of the neutron source, the characteristic response functions of the tool ($g_i$) are introduced as follows:

$$n_i = A_S \times g_i(\lambda_F, \lambda_M, d_{SO})$$

In this situation, there are more unknowns ($\lambda_F$, $\lambda_M$, $d_{SO}$, and $A_S$) than measurements ($n_1$, $n_2$). In one embodiment, the equations can be solved by treating the variable ($d_{SO}$) is treated as a known parameter (from borehole and drillstring geometry) and then estimating the formation slowing-down length ($\lambda_F$) from bottom quadrant measurements, and then solving for the remaining unknowns ($\lambda_M$ and $A_S$). In another embodiment, the equations can be solved by using the value the variable ($d_{SO}$) from the gamma ray source and detectors equations and then estimate the formation slowing-down length ($\lambda_F$) from bottom quadrant measurements, and then solve for the remaining unknowns ($\lambda_M$ and $A_S$). In another embodiment, the equations can be solved by using an epithermal neutron porosity tool (which could use a minitron generator) to provide values for the unknowns so that the equations can be solved. One example of an epithermal neutron porosity tool is the Schlumberger IPLS (Integrated Porosity-Lithology Sonde) which provides three different epithermal neutron counts at three different source-to-detector spacings and one slowing-down-time measurement, which are sufficient to solve the equations for the remaining unknowns.

In one situation, when $d_{SO}$ is zero, the function $g_i$ becomes insensitive to changes in $\lambda_M$. In the situation when $d_{SO}$ is zero, it is not possible to determine the mud properties.

In another situation, when $d_{SO}$, is large, the function $g_i$ becomes insensitive to changes in $\lambda_F$ and $d_{SO}$. In the situation when $d_{SO}$ is large, it is not possible to determine the formation properties. However, in the situation when $d_{SO}$ is large, it is possible to determine the mud neutron properties.

In another situation, when there is little contrast between the mud properties and the formation properties, the function $g_i$ becomes insensitive to changes in $d_{SO}$. In the situation when there is little contrast between the mud properties and the formation properties, it is not possible to determine the standoff ($d_{SO}$). It is possible to confuse this situation with the situation where the stand-off is very close to zero and the mud properties can be anything. The two situations expressed mathematically are:

$$g_i(\lambda_F, \lambda_M \approx \lambda_F, \text{Any } d_{SO}) \approx g_i(\lambda_F, \text{Any } \lambda_M, d_{SO} \approx 0)$$

In these and other situations, the solution to the response function ($n_i$) is not unique. In one embodiment, the situation can be addressed by treating the standoff ($d_{SO}$) as a known parameter (from borehole and drillstring geometry) and/or assuming it cannot go below a minimum value, and solving for the remaining unknowns.

In another situation, as the standoff ($d_{SO}$) between the tool and the formation increases from zero to large values, measurements including the windows counts and slowing down time will become less affected by the formation properties and more affected by the mud properties. In this situation, it is possible to confuse a situation with a large standoff and given formation properties with the situation where there is a small standoff and the formation properties are confused with those of the mud. The situation expressed mathematically is:

$$g_i(\lambda_F, \lambda_M, d_{SO} >> 0) \approx g_i(\lambda_M, \lambda_F, d_{SO} \approx 0)$$

In these and other situations, the solution to the response function ($n_i$) is not unique. In one embodiment, the issue can be addressed the issue by treating the standoff ($d_{SO}$) as a known parameter (from borehole and drillstring geometry) and/or assume it cannot go below a minimum value, and solve for the remaining unknowns.

In one embodiment, there is a problem with cuttings bed formation and kick detection if there is a small standoff ($d_{SO}$) between the formation and the tool's detectors, then it may not be possible to determine the properties of the material in that standoff. In another embodiment, the tool may be run with a stabilizer so that there is a sufficient standoff ($d_{SO}$) between the formation and the tools detectors so that it is possible to determine the properties of the material in that standoff.

In one embodiment, all of the output digital signals may be stored in mass memory devices (not illustrated) of computer 301 (see FIG. 3A) for review and possible further analysis and interpretation when the bottom hole drilling assembly is returned to the surface. Certain data, limited in amount due to band width limitations, may be transmitted to surface instrumentation via the drill string mud path from communications sub 400, or by a cable or other suitable means. In another embodiment, the data resulting from the tool's measurements may be stored for post-processing instead of being transmitted back uphole. In another embodiment, the data might be processed downhole.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

We claim:

1. A method for determining a characteristic of a mud mixture surrounding a drilling tool within an inclined borehole in which a drilling tool is conveyed, comprising:

defining a cross-section of said tool which is orthogonal to a longitudinal axis of said tool;

determining a bottom contact point of said gross-section of said tool which contacts said inclined borehole as said tool rotates in said borehole;

separating said cross-section into at least two segments, where one of said segments is called a bottom segment of said borehole which includes said bottom contact point of said cross-section of said tool which said inclined borehole;

turning said tool in said borehole;

applying energy into said borehole from an energy source disposed in said tool, as said tool is turning in said borehole;

recording measurement signals received at a sensor disposed in said tool from circumferentially spaced locations round said borehole, where said measurement signals are in response to returning energy which results from the interaction of the applied energy with said mud mixture and the formation;

deriving a density measurement from said measurement signals;

associating said density measurement with a particular segment during the time such signals are produced in response to energy returning from said mud mixture and the formation as said tool is turning in said borehole;

deriving an indication of a cuttings build-up or a kick condition based on a comparison between said density measurements associated with at least two segments of said borehole.

2. The method of claim 1, wherein an indication of a cuttings build-up or a kick condition is derived for at least three of said segments.

3. The method of claim 1, wherein an indication of a cuttings build-up or a kick condition is derived for each of said segments.

4. The method of claim 1 wherein said energy applied into said borehole is in the form of gamma rays radiated from a source of radiation, and said returning energy is in the form of gamma rays which result from interaction with said mud mixture and the formation.

5. The method of claim 1 wherein said cross-section is divided into bottom, right, top, and left segments.

6. The method of claim 5 wherein said energy applied into said borehole is in the form of gamma rays, and said returning energy is in the form of gamma rays which result from interaction with said mud mixture and the formation, the method further comprising, recording the density of a segment that said sensor is in while said tool is turning in said borehole, and recording the number of gamma ray counts of said sensor per segment for a selected recording time.

7. The method of claim 6 wherein said sensor comprises short and long spaced gamma ray detectors spaced from an energy source which emits gamma rays into said mud mixture and the formation, and further comprising, recording the number of gamma ray counts of said short spaced gamma ray detector per segment for a certain recording time, and recording the number of gamma ray counts of said long spaced gamma ray detector per segment for said certain recording time.

8. The method of claim 1, further comprising comparing said measurement signals from a plurality of segments to detect cuttings bed buildup.

9. The method claim 1, further comprising comparing said measurement signals from a plurality of segments to detect a kick.

10. The method of claim 1, further comprising detecting a cuttings build-up or a kick condition when a density measurement of a bottom segment of the borehole is less than a density measurement of a top segment of the borehole.

11. A method for determining density of a mud mixture surrounding a drilling tool within an inclined borehole in which said drilling tool is received, comprising:

determining a bottom contact point of said tool which contacts said inclined borehole while said tool is rotating in said borehole defining a bottom angular distance of said borehole for said tool which includes said bottom contact point;

defining at least one more angular distance of said borehole;

applying gamma rays into said mud mixture from a radiation source;

recording, as a function of angular distance of said tool with respect to the borehole for a predetermined time period, a count rate of gamma rays which return to the tool which result from interaction with said mud mixture;

determining a density of the mud mixture from the count rate of gamma rays for at least two segments of said borehole; and determining an indication of a cuttings build-up or a kick condition based on a comparison of said densities of said mud mixture for said at least two segments with at least one of each other and a known density of said mud mixture.

12. The method of claim 11 further comprising, defining other angular distances of said tool about said borehole, and determining the density of the mud mixture for a plurality of said angular distances from the gamma ray count rates which occur solely within said angular distances about said borehole.

13. The method of claim 12 further comprising, determining the density of the mud mixture for each of said angular distances from the gamma ray count rates which occur solely within said angular distances about said borehole.

14. The method of claim 12, further comprising comparing said density measurements from a plurality of angular distances to detect cuttings bed buildup.

15. The method of claim 12, further comprising comparing said density measurements from a plurality of angular distances to detect a kick.

16. The method of claim 11 wherein said gamma ray count rates are recorded as to their respective energy levels, called windows, thereby producing a spectrum of count rates with certain higher energy level windows being designated as hard windows and with certain lower energy level windows being designated as soft windows.

17. The method of claim 16 wherein for each distinct angular distance about said borehole, count rates of hard windows which occur solely within a distinct angular distance are used to determine density of the mud mixture.

18. The method of claim 11, further comprising detecting a cuttings build-up or a kick condition when a density measurement of a bottom segment of the borehole is less than a density measurement of a top segment of the borehole.

19. A method for determining photoelectric effect (PEF) of a mud mixture within a borehole in which a tool is received, said tool including a source of radiation, a short spaced gamma ray detector and a long spaced gamma ray detector, the method comprising:

identifying particular angular segments of said borehole through which said short spaced detector and said long spaced detector pass while said tool is rotating in said borehole;

recording for a predetermined time period a count rate of gamma rays in said short spaced detector and in said long spaced detector as a function of said particular angular segments, where said gamma rays result from interaction of gamma rays from said source with said mud mixture, and where said count rate of gamma rays of said short spaced detector and of said long spaced detector are recorded as to their respective energy levels called windows, thereby producing a spectrum of count rates with certain higher energy level windows being designated as hard windows and with certain lower energy level windows being designated as soft windows;

determining average density ($\rho_{AVG}$), of the mud mixture; and determining a macroscopic cross section, called $U_{AVG}$, of the mud mixture as a function of total soft window count rate of one of said detectors and total hard window count rate of said one of said detectors;

determining an average PEF of said mud mixture as a ratio of said macroscopic cross section to said average density, that is, $$PEF_{AVG}=U_{AVG}/\rho_{AVG}; \text{ and}$$

deriving an indication of a cuttings buildup or a kick condition based on a comparison of the average PEF an either a known PEF of said mud mixture or at least one of a previously determined average PEF.

20. The method of claim 19 wherein said average density ($\rho_{AVG}$) of said mud mixture is determined from the steps of determining a total hard window count rate from said short spaced detector, determining a total hard window count rate from said long spaced detector, and applying said short spaced detector hard window count rate and said long spaced detector hard window count rate to a spine and ribs representation of the response of a two-detector density device to formation density and drilling mud and mudcake.

21. The method of claim 19 further comprising:

determining average density of a particular angular segment ($\rho_{AVG\ SEGMENT}$);

determining a macroscopic cross section of said particular angular segment ($U_{AVG\ SEGMENT}$) as a function of soft window count rate of said one of said detectors for said particular angular segment and hard window count rate of said one of said detectors for said particular angular segment; and determining an average PEF of said particular angular segment as a ratio of said $U_{AVG\ SEGMENT}$ to said $\rho_{AVG\ SEGMENT}$, that is, $$PEF_{AVG\ SEGMENT}=U_{AVG\ SEGMENT}/\rho_{AVG\ SEGMENT}.$$

22. The method of claim 19, further comprising comparing said PEF measurements from a plurality of angular segments to detect cuttings bed buildup.

23. The method of claim 19, further comprising comparing said PEF measurements from a plurality of angular segments to detect a kick.

24. The method of claim 19, further comprising detecting a kick condition when the average PEF is less than the known PEF of the mud mixture.

25. The method of claim 19, further comprising detecting a kick condition when the average PEF is less than a previously determined average PEF of the mud mixture.

* * * * *